US010704802B2

(12) United States Patent
Fioriti

(10) Patent No.: US 10,704,802 B2
(45) Date of Patent: Jul. 7, 2020

(54) WATER HEATING APPARATUS WITH PARALLEL HEAT EXCHANGERS

(71) Applicant: Aerco International, Inc., Blauvelt, NY (US)

(72) Inventor: Gerald A. Fioriti, Rock Tavern, NY (US)

(73) Assignee: Aerco International, Inc., Blauvelt, NY (US)

( * ) Notice: Subject to any disclaimer, the term of this patent is extended or adjusted under 35 U.S.C. 154(b) by 199 days.

(21) Appl. No.: 16/017,316

(22) Filed: Jun. 25, 2018

(65) Prior Publication Data

US 2018/0356125 A1 Dec. 13, 2018

Related U.S. Application Data

(63) Continuation-in-part of application No. 13/892,920, filed on May 13, 2013, now Pat. No. 10,030,887.
(Continued)

(51) Int. Cl.
*F24H 1/10* (2006.01)
*F24H 9/12* (2006.01)
(Continued)

(52) U.S. Cl.
CPC ..... *F24H 1/107* (2013.01); *F24H 9/128* (2013.01); *F24H 9/146* (2013.01); *F24H 9/1836* (2013.01);
(Continued)

(58) Field of Classification Search
CPC ..... F24H 1/107
See application file for complete search history.

(56) References Cited

U.S. PATENT DOCUMENTS 61,278 A 1/1867 Sturdy
348,932 A 9/1886 Rugg
(Continued)

FOREIGN PATENT DOCUMENTS

EP 114980 A2 8/1984
JP H01169270 A 7/1989
(Continued)

OTHER PUBLICATIONS

U.S. International Searching Authority International Search Report and Written Opinion for Corresponding International Application No. PCT/US2013/040769 dated Sep. 10, 2013 (13 pgs).
(Continued)

*Primary Examiner* — Nathaniel Herzfeld
(74) *Attorney, Agent, or Firm* — Harris Beach PLLC

(57) ABSTRACT

A water heating apparatus includes a water inlet port and a hot water supply connection water outlet port. A burner assembly includes a burner disposed within a combustion chamber housing. At least two heat exchangers are operated in parallel. At least two of the at least two heat exchangers have at least a first heat exchanger water inlet port on a same side of the water heating apparatus. A water jacket is defined by an area between an outer containment vessel and the combustion chamber housing. The heated water flows out of each of each of the at least two heat exchangers through the portion of each of the at least two heat exchangers into the water jacket. The heated water which flows into the water jacket is further heated by the combustion chamber housing and the further heated water exits the water heating apparatus at the hot water supply connection water outlet port.

16 Claims, 20 Drawing Sheets

Related U.S. Application Data

(60) Provisional application No. 61/646,346, filed on May 13, 2012.

(51) Int. Cl.

| | |
|---|---|
| ***F28F 9/26*** | (2006.01) |
| ***F24H 9/18*** | (2006.01) |
| ***F28D 7/16*** | (2006.01) |
| ***F24H 9/14*** | (2006.01) |
| *F28D 21/00* | (2006.01) |

(52) U.S. Cl.

CPC ..... *F28D 7/16* (2013.01); *F28F 9/26* (2013.01); *F28D 2021/0024* (2013.01)

(56) References Cited

U.S. PATENT DOCUMENTS

| | | | | | |
|---|---|---|---|---|---|
| 1,037,029 | A | | 8/1912 | Lukacs | |
| 3,198,432 | A | | 8/1965 | Grayson | |
| 3,200,793 | A | | 8/1965 | Cleaver | |
| 3,219,017 | A | * | 11/1965 | Thybault | F22B 1/08 122/250 R |
| 4,023,558 | A | * | 5/1977 | Lazaridis | F24H 1/12 122/18.31 |
| 4,485,010 | A | | 11/1984 | Strauss et al. | |
| 4,550,710 | A | * | 11/1985 | McDonald, II | F24D 17/00 122/13.01 |
| 4,657,506 | A | | 4/1987 | Ihlenfield et al. | |
| 4,871,014 | A | | 10/1989 | Sulzberger | |
| 5,022,352 | A | | 6/1991 | Osborne et al. | |
| 5,775,268 | A | | 7/1998 | Ferguson | |
| 5,881,681 | A | | 3/1999 | Stuart | |
| 6,279,870 | B1 | | 8/2001 | Welz, Jr. et al. | |
| 6,435,862 | B1 | | 8/2002 | Fioriti et al. | |
| 6,470,836 | B1 | | 10/2002 | Manley et al. | |
| 2002/0148415 | A1 | | 10/2002 | Manley et al. | |
| 2008/0017361 | A1 | | 1/2008 | Van Decker et al. | |
| 2008/0223314 | A1 | * | 9/2008 | Le Mer | F24H 1/43 122/53 |
| 2013/0042822 | A1 | * | 2/2013 | Fioriti | F24H 1/36 122/14.21 |

FOREIGN PATENT DOCUMENTS

| | | | |
|---|---|---|---|
| JP | H02124441 | U | 10/1990 |
| JP | H04129650 | U | 11/1992 |
| JP | 2001208344 | A | 8/2001 |
| WO | WO-198702763 | A1 | 5/1987 |
| WO | WO-199966267 | A1 | 12/1999 |
| WO | WO-03062705 | A1 | 7/2003 |
| WO | WO-2012013405 | A2 | 2/2012 |

OTHER PUBLICATIONS

European Patent Office Supplementary European Search Report for Corresponding European Application No. EP13791135, dated Mar. 1, 2016 (7 pgs).

Extended European Search Report for corresponding European Application No. 18152976.9 dated Apr. 19, 2018 (8 pgs).

* cited by examiner

WATER HEATING APPARATUS WITH PARALLEL HEAT EXCHANGERS

CROSS REFERENCE TO RELATED APPLICATION

This application is a continuation-in-part of U.S. patent application Ser. No. 13/892,920, filed May 13, 2013, entitled WATER HEATING APPARATUS WITH PARALLEL HEAT EXCHANGERS, which claims priority from and the benefit of U.S. Provisional Application Ser. No. 61/646,346, filed May 13, 2012, entitled WATER HEATING APPARATUS WITH PARALLEL HEAT EXCHANGERS, both of which applications are incorporated herein in their entirety by reference.

FIELD OF THE INVENTION

This disclosure relates generally to a water heating system and, more specifically, to a water heating system that achieves high thermal output yet occupies a small footprint and operates over a broad modulation range.

BACKGROUND OF THE INVENTION

Hydronic boilers are used in generating heat for residential and industrial purposes. The hydronic boiler operates by heating water to a preset temperature and circulating the water throughout the building, typically by way of radiators, baseboard heaters, or through the floors. Typically, the water is heated by a natural gas burner. The water is in an enclosed system and circulated throughout the structure by a pump.

Hydronic boilers typically include a pressure vessel with internal heat exchange tubes in contact with flowing water. In one type of water heating apparatus, known as a fire tube boiler, hot combustion gases flow internally through the heat exchange tubes and the water to be heated flows around the tubes, picking up the heat. In another type of conventional water heating apparatus, water rapidly flows within the heat exchange tubes and the heat source is exposed to the outside of the tubes.

The water volume of a hydronic boiler pressure vessel is a function of the building's thermal demand and the output capacity of the heat exchange system. The operating water pressure in a hydronic boiler can be as high as 80 psi or even 160 psi. Therefore, in large-scale or industrial hydronic boilers, the pressure vessel may be quite large, over four feet in diameter.

SUMMARY OF THE INVENTION

According to one aspect, a water heating apparatus includes a water inlet port and a hot water supply connection water outlet port. A burner assembly includes a burner disposed within a combustion chamber housing. At least two heat exchangers are operated in parallel. Each of the at least two heat exchangers is fluidly coupled to the water inlet port. At least two of the at least two heat exchangers have at least a first heat exchanger water inlet port on a same side of the water heating apparatus. Each of the heat exchangers has an outer housing and disposed within a plurality of heat exchange tubes and a portion through which a heated water exits each of the at least two heat exchangers. A water jacket is defined by an area between an outer containment vessel and the combustion chamber housing. A hot combustion gas from the burner assembly flows through each of the at least two heat exchangers to heat a cold water from the at least a first heat exchanger water inlet port to a heated water. The heated water flows out of each of each of the at least two heat exchangers through the portion of each of the at least two heat exchangers into the water jacket. The heated water which flows into the water jacket is further heated by the combustion chamber housing and the further heated water exits the water heating apparatus at the hot water supply connection water outlet port.

In one embodiment, the water heating apparatus includes an elbow fluidly coupled to the water inlet port of each of the at least two heat exchangers by a distribution section of a supply leg, the elbows and the distribution section disposed on a same side of the water heating apparatus.

In another embodiment, the elbow includes about a 30 degree elbow.

In yet another embodiment, each of the at least a first heat exchanger water inlet port of each of the at least two heat exchangers is disposed at about a 20 degree offset from a 90 degree axis line from a center of each heat exchanger to a side of the water heating apparatus.

In yet another embodiment, each heat exchanger of at least two of the at least two heat exchangers include at least two heat exchanger water inlet ports, and an elbow fluidly coupled to each of the at least two heat exchanger water inlet port of each of the at least two heat exchangers by at least two distribution sections of at least two supply legs, the elbows and the at least two distribution sections disposed on a same side of the water heating apparatus.

In yet another embodiment, the hot combustion gas flows through the inside of the heat exchange tubes, while a water to be heated flows within the outer housing in heat exchange relationship around an exterior of the heat exchange tubes.

In yet another embodiment, within each of the at least two heat exchangers, the hot combustion gas flows in a first direction, while a water to be heated flows in an opposite direction.

In yet another embodiment, at least one of the at least two heat exchangers includes a baffle.

In yet another embodiment, the baffle is welded at an expansion joint below an upper tubesheet as a flow diverter.

In yet another embodiment, the baffle includes a circular disk with a central opening.

In yet another embodiment, the baffle includes a disk with a central, downward indentation with openings at its edges.

In yet another embodiment, the outer containment vessel includes a carbon steel.

In yet another embodiment, the combustion chamber housing includes a stainless steel.

In yet another embodiment, the at least two heat exchangers operated in parallel receive a substantially equal water flow and water pressure from the water inlet port.

In yet another embodiment, each heat exchanger of the at least two heat exchangers includes the first heat exchanger water inlet port, and a second heat exchanger water inlet port disposed between the first heat exchanger water inlet port and an end of a heat exchanger nearest the water jacket on a same side of the water heating apparatus. The first heat exchanger water inlet port is adapted to receive a first return water from a first water return line of a building. The second heat exchanger water inlet port is adapted to receive a second return water from a second return water line of the building. The second return water has a higher temperature than the first return water.

In yet another embodiment, a blending of warm and cool water from a building's warm and cool water return lines blends directly within each of the heat exchangers which causes a blending efficiency that is about 1% to 5% higher, in comparison to an alternative prior art structure where a blending of warm and cool water return lines occurs prior to entering the water heating apparatus.

In accordance with one aspect of the disclosure, a water heating apparatus includes a fluid inlet conduit configured to split into a plurality of supply legs, and a plurality of heat exchangers. Each heat exchanger includes an outer housing, an inlet connected to a respective supply leg of the fluid inlet conduit for receiving an inlet flow of liquid into the outer housing, an outlet for allowing an outlet flow of liquid to leave the outer housing, and a heat exchange element positioned within the outer housing and configured to heat a flow of liquid passing through the outer housing from the inlet to the outlet. The water heating apparatus further includes a burner assembly. The burner assembly includes a combustion chamber housing and a burner positioned internally within the combustion chamber housing. The burner assembly is coupled to the plurality of heat exchangers for supplying heat to the flow of liquid. The plurality of heat exchangers is configured for parallel operation.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
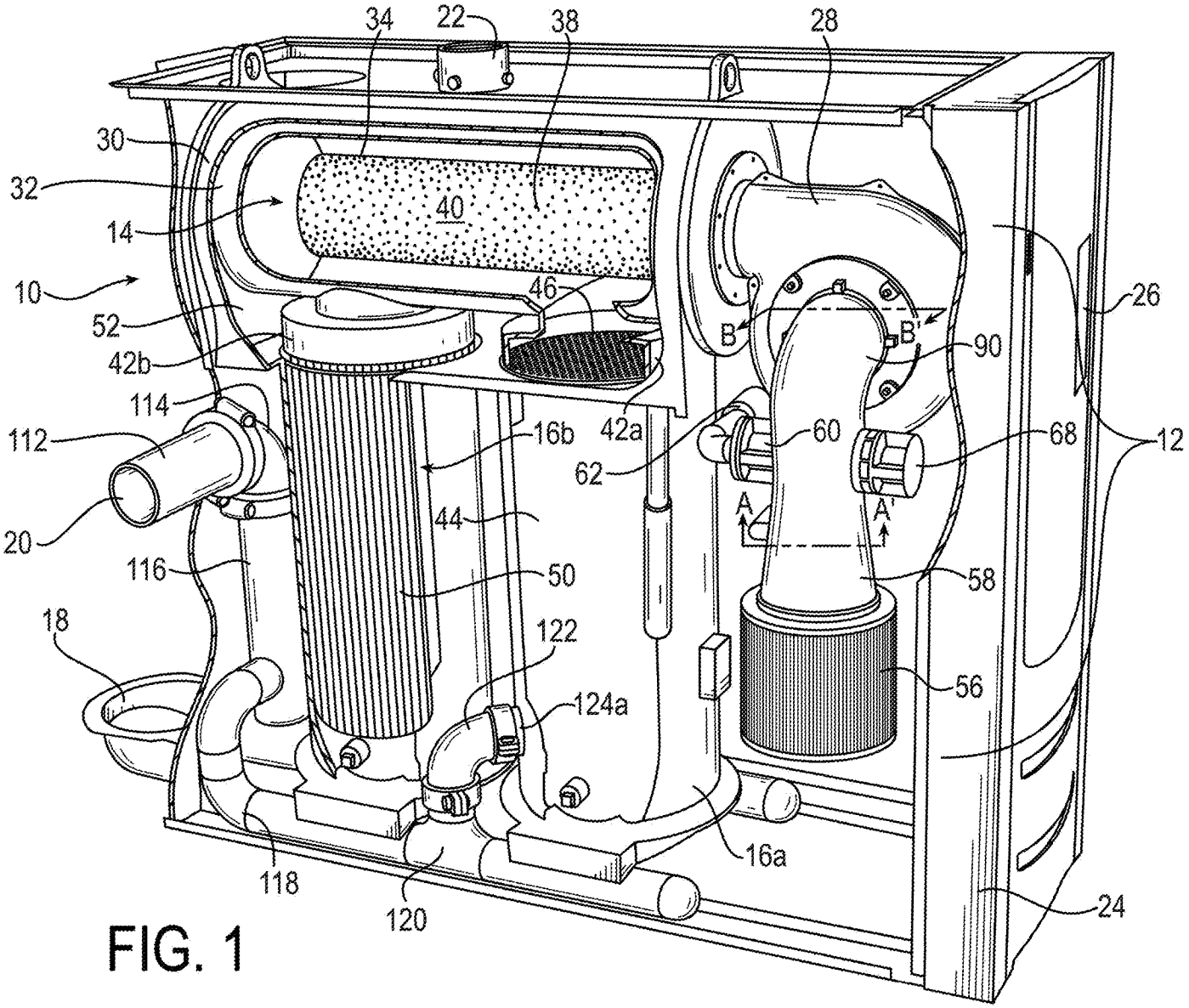
FIG. 1 depicts a three-dimensional perspective view of a water heating apparatus according to one embodiment of the present invention.

Referring to FIG. 1, an exemplary embodiment of a water heating apparatus 10 in accordance with the invention includes an air fuel delivery system 12, a burner assembly 14, a plurality of heat exchangers 16*a*, 16*b*, and a combustion gas exhaust manifold 18. The water heating apparatus 10 further includes a water inlet port 20 or cold water return connection, and a water outlet port 22 or hot water supply connection. Obscured by the enclosure 24 is a controller 26 to control the operation of the water heating apparatus 10. The controller 26 is configured to control the temperature regulation, safety monitoring, and diagnostic functions of the water heating apparatus 10.

Briefly, operation of the water heating apparatus 10 will next be described. Details of particular elements will be provided below. The heat exchangers 16*a*, 16*b* provide for heat transfer between a first fluid (preferably a hot gas) and a second fluid (preferably water). Air and fuel are pre-mixed in the air fuel delivery system 12 and delivered to the burner assembly 14 by blower 28. The burner assembly 14 includes an outer containment vessel 30, a combustion chamber housing 32 disposed inside the outer containment vessel, and a burner 34 positioned internally within combustion chamber housing 32. The outer containment vessel 30 may be formed of carbon steel, and the combustion chamber housing 32 may be formed of stainless steel. The combustible mixture is ignited in the burner 34 by igniter 36 (not shown). Mesh 38 surrounds the burner 34 to provide a flame front and aide in stable combustion over a wide range of operating parameters. The hot combustion exhaust gases collect in area 40 defined by the combustion chamber housing 32 and the mesh 38, and are directed to the heat exchanger 16*a*, 16*b* via expansion joints 42*a*, 42*b*. Expansion joints 42 couple combustion chamber housing 32 to heat exchanger 16, and act to absorb stresses due to thermal expansion and contraction of the burner assembly 14 relative to the heat exchangers 16*a*, 16*b*. In one example, the expansion joint 42 defines an opening to the heat exchanger 16 that is approximately 12 inches in diameter.

In the illustrated embodiment, heat exchangers 16*a*, 16*b* are substantially identical, and the description of one heat exchanger will serve to describe both. It is further noted that for reasons to be fully explained herein below, the water heating apparatus 10 of the present invention requires at least two heat exchangers, but can include three, four, or more heat exchangers depending upon the particular requirements of the installation.

Heat exchanger 16 may be constructed from an upright, cylindrical outer housing 44 and two tubesheets, an upper tubesheet 46 at the combustion gas inlet/water flow exit, and a lower tubesheet 48 (obscured from view) at the combustion gas exit/water flow inlet. The upper tubesheet 46 and the lower tubesheet 48 are welded at their periphery to the respective portion of the outer housing 44. The heat exchanger 16 further includes at least one, but preferably a plurality, of heat exchange tubes 50. In one embodiment, the tubesheets 46, 48 are flat disks having a plurality of holes in which the heat exchange tubes 50 fit. The heat exchange tubes 50 are welded between the two tubesheets 46, 48. In one example, the lower tubesheet 48 contains a circular pattern of holes along its outer edge through which inlet water may flow.

The heat exchanger 16 in the illustrated embodiment is of the type known as a fire tube unit. That is, the hot combustion gases flow through the inside of the heat exchange tubes 50, while the water to be heated flows in heat exchange relationship around the exterior of the heat exchange tubes 50. In this manner, the hot gas flows in a downward direction through the heat exchange tubes 50, and the water flows upward such that it increases in temperature establishing a temperature gradient in the direction of flow of water. The combustion gases, having given up a large portion of their thermal energy, are directed out the bottom of each heat exchangers 16*a*, 16*b* to a central plenum or combustion exhaust manifold 18. The combustion exhaust manifold 18 is coupled to an exhaust pipe (not shown) that directs the gases to the outside environment of the facility.

Accordingly, the disclosed configuration allows water to travel in physical isolation from, but in heat exchange relation with, the hot gases passing through the combustion chamber and the heat exchange tubes 50. As the water flows upwards in true counterflow to the hot gases, heat is transferred to the water, causing a temperature gradient in the direction of the water flow. Conversely, as the gases flow downwards, they are cooled in traversing the heat exchange tubes 50.

The true counterflow movement of the water and gases provides for excellent efficiency of operation. As the gases are cooled below their dew point, they condense, providing additional heat to the flow of water by way of energy release of condensation. Efficiency levels greater than 90 percent, not possible without the condensing operation, are thus achieved. Moreover, the condensing operation is advantageous because the movement of condensate droplets or film through the heat exchange tubes 50 helps to sweep out any carbon particles that may accumulate in the tubes, thereby maintaining optimal heat transfer.

The modulation of the water heating system over a broad range is also advantageous to the efficiency of its operation. Since the water heating system modulates over a broad range, the onset of condensation occurs at varying positions along the length of the heat exchange tubes 50. Thus, any corrosion that occurs is distributed over the heat exchange tubes instead of accumulating in one area.

In one embodiment of the present invention, the heat exchange tubes 50 are straight tubes, 44 inches long, and formed from ⅝ inch diameter stainless steel tube. Each heat exchanger 16*a*, 16*b* includes 322 such tubes. The heat exchange tubes 50 may include spiral grooves FIG. 9E, 950 or the like on the tube exterior surface. The spiral grooves 950 increase the velocity and turbulence of the water flowing over the tubes 50, which improves the heat transfer from the hot gases to the water. The spiral groove 950 also reduces the stresses caused by tube thermal expansion and contraction. Although the tubes are constrained at each end (e.g., brazed or welded at the upper tubesheet 46 and lower tubesheet 48), the spiral geometry allows significant expansion and contraction without overstressing the braze joints. The spiral angle, depth, and pitch of the grooves provide far superior heat exchange characteristics as compared to straight-wall tube. For example, the heat exchange tubes 50 disclosed herein provide 4.5 times the heat transfer capability over conventional tubes.

The heated flow of water exiting the upper portion of the heat exchanger 16 enters a water jacket 52 defined by the area between the outer containment vessel 30 and the combustion chamber housing 32. In one embodiment of the invention, a baffle 54 (FIG. 9D) is included in the water jacket 52 to optimize operation of the heat exchanger. The baffle 54 is welded at the expansion joint 42 just below the upper tubesheet 46, and it serves as a flow diverter which optimizes water flow distribution in the heat exchanger. In the illustrated embodiment, the baffle 54 is a flat, circular disk with a central opening. In another embodiment (not shown), the baffle may be a disk with a central, downward indentation with openings at its edges. After picking up additional heat in the water jacket 52 from the burner assembly 14, the water exits the water heating apparatus 10 via water outlet port 22.

The air fuel delivery system 12 includes an air filter 56 to remove airborne particulates from the air intake stream. The air filter 56 couples to an intake conduit 58 that connects to blower 28. The intake air stream is mixed with fuel in an air fuel valve assembly 60. A gas train 62 connects to the air fuel valve assembly 60 to provide gaseous fuel to the valve. The fuel can include a plurality of suitable gases, for example compressed natural gas (CNG). The chemical composition of the CNG can vary and many suitable compositions are contemplated herein. In one embodiment, the CNG comprises methane, ethane, propane, butane, pentane, nitrogen ($N_2$), and carbon dioxide ($CO_2$).

Figure 2:
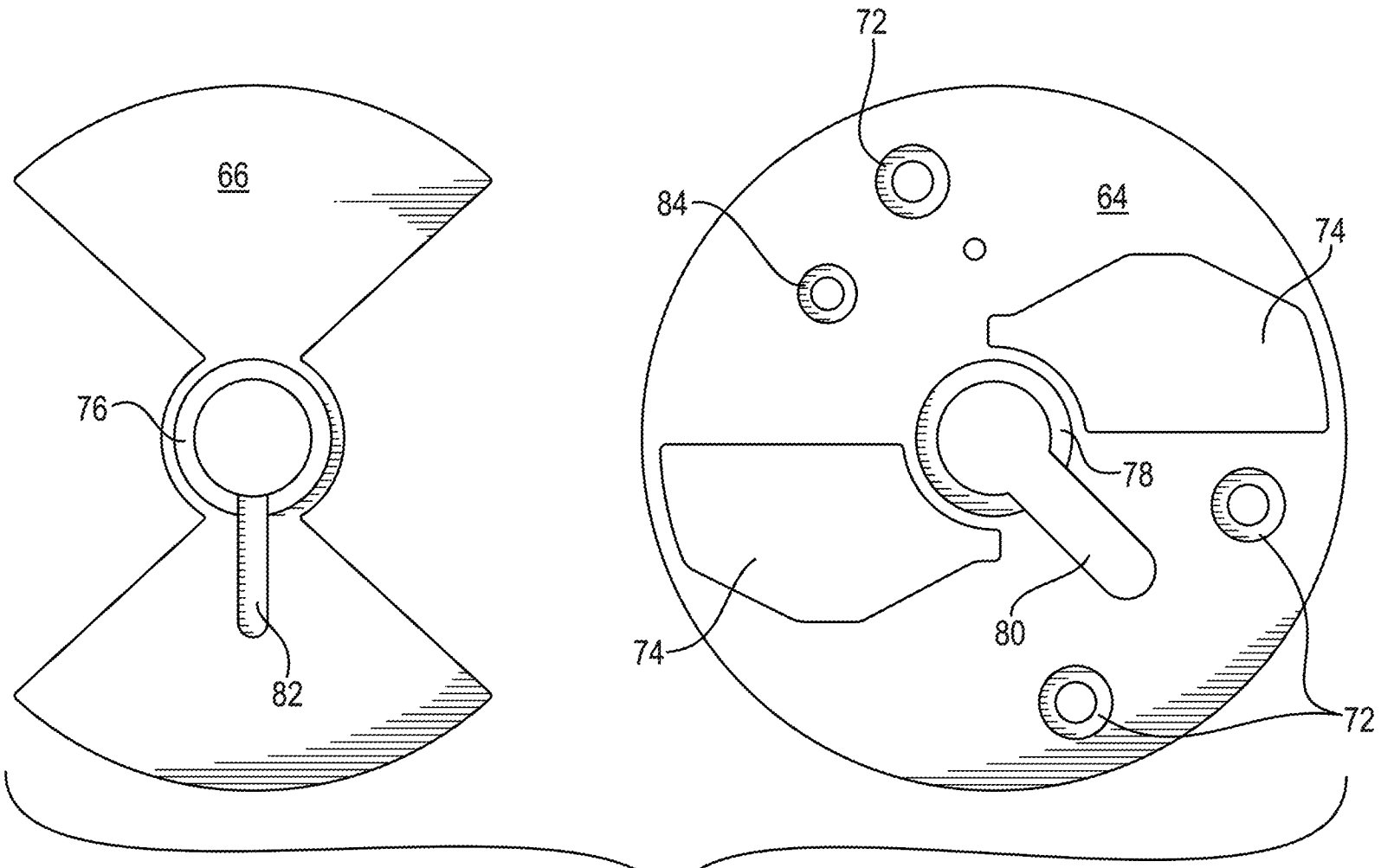
FIG. 2 depicts a top view of an exemplary embodiment of a gas flow plate and shutter in accordance with the present invention.
Figure 3:
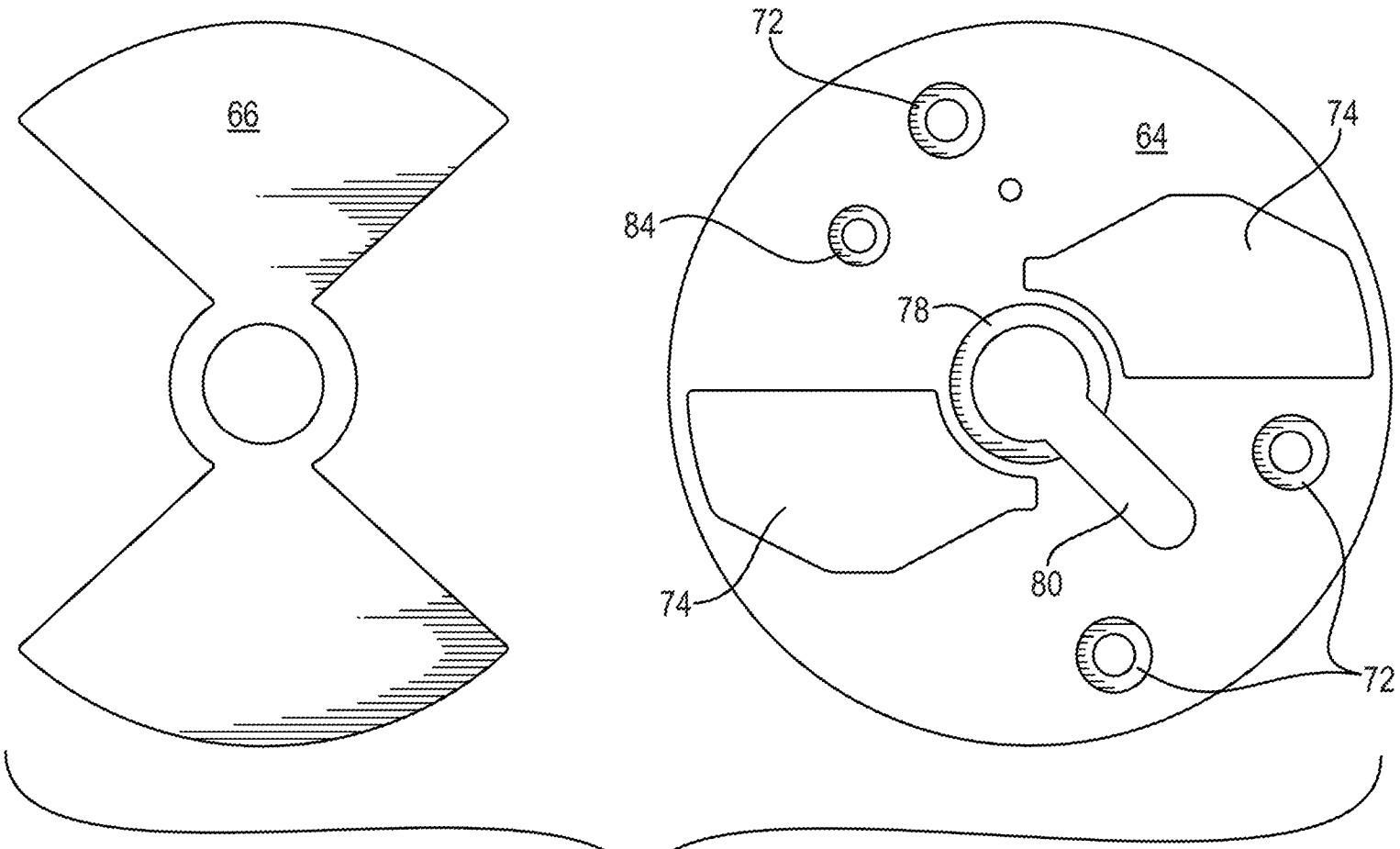
FIG. 3 depicts a bottom view of the gas flow plate and shutter of FIG. 2.

Referring to FIGS. 1-3, in one embodiment the air fuel valve assembly 60 is a rotary valve having a stationary gas flow plate 64 and a rotatable shutter 66. A valve housing 68 mounted to the intake conduit 58 includes a rotatable shaft 70 (not visible) that is actuated by the controller 26. The central axis of the shutter 66 is connected to the shaft 70; thus the shutter 66 rotates through the same angular movement as the shaft 70. In one example, the shutter is formed of an engineered plastic such as polyoxymethylene (i.e., Delrin AF-100 sold by DuPont).

The gas flow plate 64 is fixedly attached to the intake conduit 58 by mounting holes 72. The gas flow plate 64 includes area openings 74 for metering fuel flow. The shutter 66 is positioned such that rotation thereof results in blockage of the area openings 74, thereby metering the flow. In one example, the valve shaft rotation provides for a change in area openings 74 that is linearly responsive to a control signal from the temperature controller 26. Preferably, the flows of air and gas to the burner assembly 14 are at a substantially constant ratio producing an air/fuel mixture in the burner with excess oxygen of 5 percent. This ratio has been found to produce the best mixture for combustion. In one embodiment, the gas flow plate 64 is formed of aluminum and the external surfaces hard anodized to improve wear resistance.

Several features have been incorporated into the design of the air fuel valve assembly 60 to achieve the large turndown ratio. In one example, one face of the shutter 66 includes a cylindrical protrusion 76 for registration with a corresponding cylindrical recess 78 in the gas flow plate 64. The relative dimensions can be machined with great accuracy, thereby maintaining excellent concentricity between the two parts. In another example, the gas flow plate 64 includes a registration slot 80 extending radially from one side of the central axis. The registration slot 80 corresponds to a like slot 82 in the shutter 66. In one example, the slots 80, 82 can be offset from the centerline. A registration pin (not shown) can engage both the registration slot 80 in the gas flow plate 64 and the corresponding slot 82 in the shutter 66. The inventors have determined that, unlike prior art designs that include a pair of opposing registration slots extending radially from the central axis, a single radially slot significantly decreases the potential for relative movement between the gas flow plate 64 and the shutter 66. In this manner, the shutter 66 can be controlled with higher precision.

In another example, the gas flow plate 64 may include an auxiliary port 84 for turndown adjustment control. Although the features described above contribute to a very high turndown ratio, i.e., up to 20:1, there may be unit-to-unit variation in the water heating apparatus 10. The turndown adjustment control allows a small amount of fuel to be metered through the auxiliary port 84 in the gas flow plate 64 regardless of the shutter 66 position, so the performance characteristics of all water heating units will be substantially the same.

Figure 4:
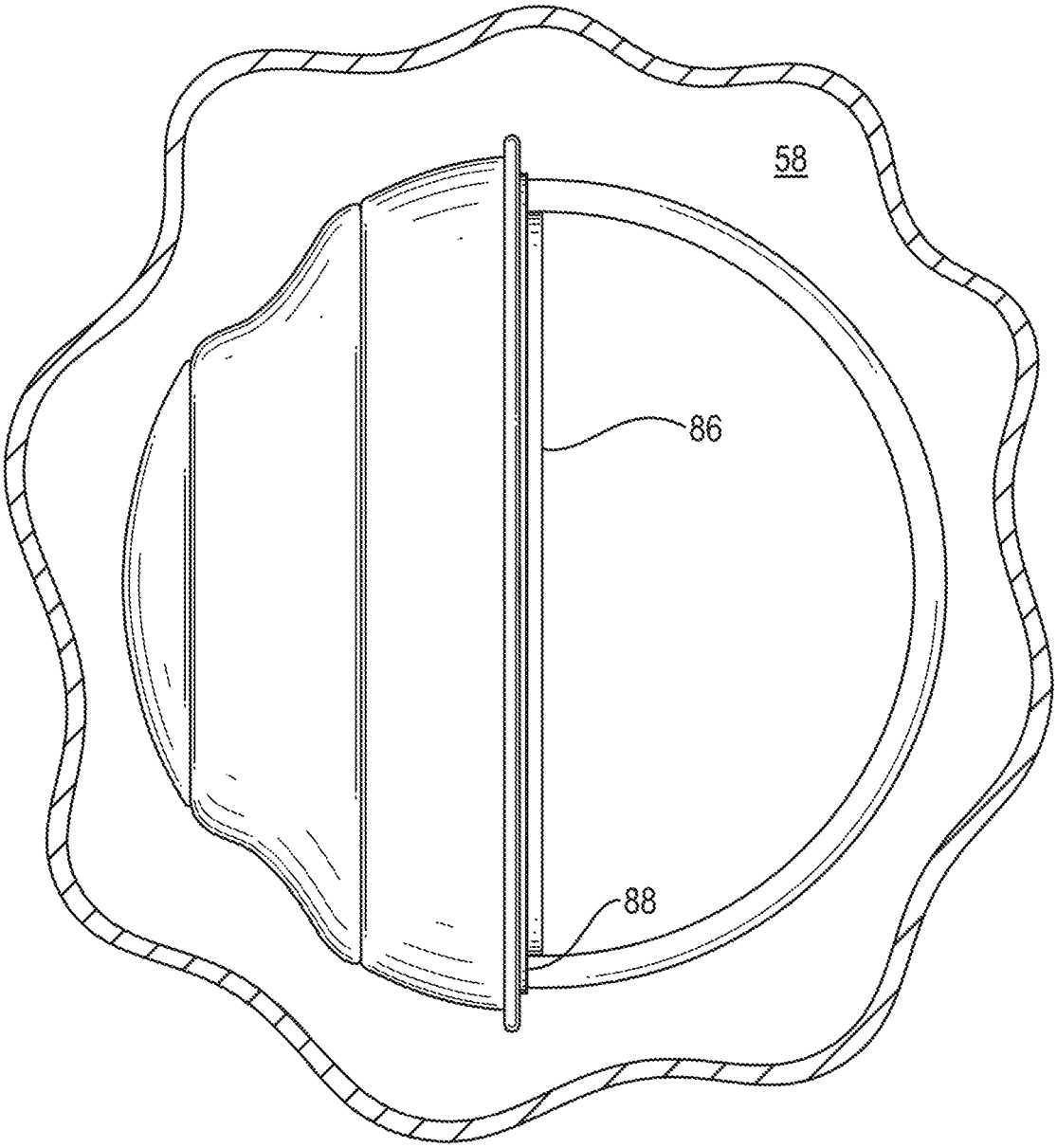
FIG. 4 depicts a sectional view of an intake conduit taken along line A-A' of FIG. 1.

Referring now to FIGS. 1 and 4, the air fuel valve assembly 60 further includes a butterfly valve 86 in the air intake conduit 58 to meter the amount of air drawn into the blower 28. The butterfly valve 86 can be connected to the shaft 70 in the valve housing 68 to allow for separate but relatively proportional flow to the burner assembly 14. The butterfly valve 86 includes a rubber sealing ring 88 around the outer circumference thereof to prevent leakage between the rotatable valve flapper and the inner wall of the intake conduit 58.

Figure 5:
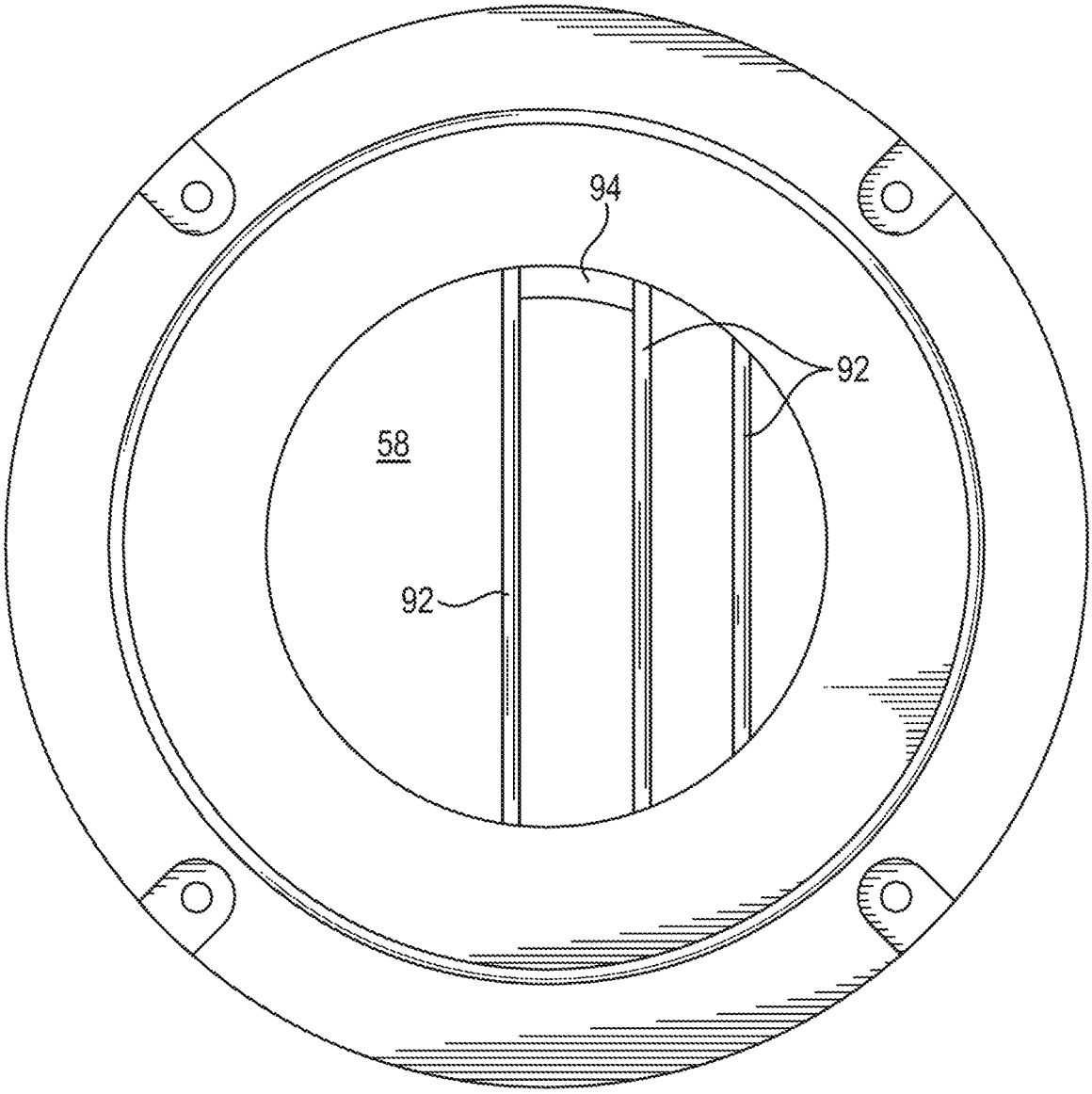
FIG. 5 depicts a sectional view of an intake conduit taken along line B-B' of FIG. 1.

Referring now to FIGS. 1 and 5, due to the compact configuration of the water heating apparatus 10, the intake conduit 58 includes a sharp bend 90 between the air fuel valve assembly 60 and the blower 28. The geometry through bend 90 tends to maldistribute the flow within the conduit, which results in poor mixing of the fuel and air and an uneven pressure distribution across the inlet of the blower 28, which adversely affects performance. The intake conduit 58 therefore includes curved flow guide vanes 92 in the bend 90 to provide a more uniform flow distribution. However, with the addition of the flow guide vanes 92, the inventors observed a large increase in carbon monoxide (CO) levels in the combustion exhaust manifold 18, indicating poor mixing of the fuel and air. Believing the rise in CO levels was attributable to the thermodynamic phenomenon of flow reattaching to a wall upon expansion through an orifice, the inventors added a trip plate 94 between a set of two vanes 92 in order create turbulence. Carbon monoxide levels were subsequently reduced. In one embodiment, the trip plate 94 may be positioned between two vanes 92 at the outer flow diameter, and protrude into the radial profile of the flow between 3 percent and 30 percent of the radial profile. In another embodiment, the trip plate 94 may be positioned between two or more sets of vanes 92.

Figure 6:
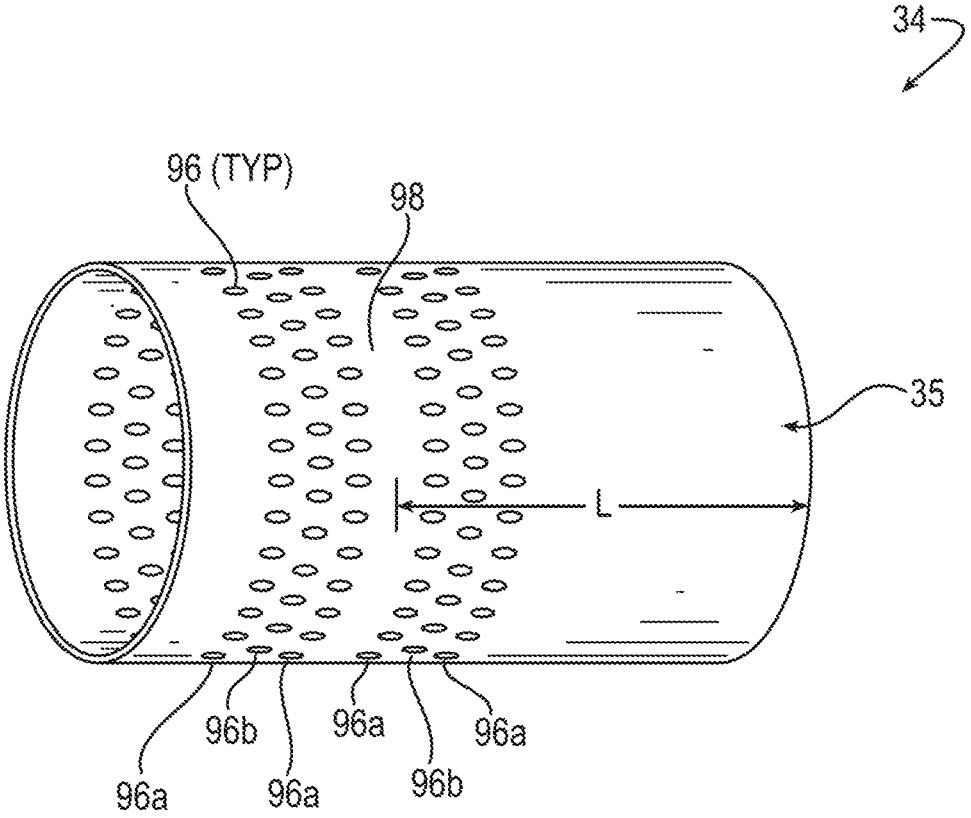
FIG. 6 depicts a plan view of the burner of FIG. 1.

Referring now to FIGS. 1 and 6, the burner 34 is shown in greater detail. As stated above, the burner 34 is provided inside the combustion chamber housing 32 to facilitate the combustion of gas that enters the combustion chamber. The burner 34 can include a variety of suitable configurations. In one embodiment, the burner 34 comprises a cylindrical short flame low nitrogen oxide (NOx) mesh burner, as illustrated in FIG. 1. In the embodiment having a cylindrical mesh burner, the burner 34 has a tubular configuration and is formed of a single sheet. During operation, a flame is positioned on the exterior of the burner 34. The burner 34 can have an inner sleeve 35 defining a plurality of apertures 96 along the sidewalls thereof, as depicted in FIG. 6 (shown without mesh). In this embodiment, the combustible gas mixture can exit the burner 34 through the plurality of holes 96 or through the end of the burner (i.e., left side of FIG. 1). Once the gas exits through either the plurality of holes or the end of the burner, the gas interacts with the flame of the burner and combusts to produce products of combustion. The combustion of gases using a low nitrogen oxide (NOx) mesh burner is completed in a short distance to the burner exterior. In one example, the burner can maintain a temperature of approximately 2000° F. to 2600° F. (1093° C. to 1427° C.) for a 6 million BTU/hr. boiler. The controller 26 can control the temperature of the burner and the size of the flame. The burner can be formed of a plurality of suitable materials, including, but not limited to stainless steel, ceramic, and inter-metallic materials.

Another improvement to the water heating apparatus 10 stemmed from the realization that the pattern of apertures 96 in the burner 34 can greatly affect acoustic resonances and therefore the decibel level of the water heating apparatus 10 while in operation. Prior art attempts at breaking up acoustic resonances in the burner section include drilling holes in the inlet, adding a center tube in the burner, or adding a divider in the center of the burner. Although these attempts may be useful in some applications, they add complexity and cost.

In one embodiment of the present invention, the pattern of apertures 96 comprises cylindrical rows of equally spaced holes. The holes can be drilled at an angle to improve combustion performance. The pattern of equally spaced holes 96 in each row can be angularly offset (or "clocked") from the preceding row and the following row. For example, referring to FIG. 6, there are two different patterns of cylindrical rows, with the holes **96*a* in one row being positioned in between the holes 96*b* in the other row. The pattern of apertures 96 may include a "dead row" 98 or interrupted hole pattern wherein no holes are present. The dead row 98 is positioned at an axial length "L" along the burner so as to disrupt the driving force of the acoustic resonance. The distance L is a function of the burner dynamic performance, but can be determined empirically or experimentally. In one example, the dead row 98 is located approximately mid-span or half way down the length of the burner 34. In the illustrated example corresponding to a 6 million BTU/hr water heater, the dead row 98 is located approximately every 11 inches down the length of the burner 34**.

The inventor's testing reports that incorporation of an interrupted hole pattern or dead row 98 in a water heating apparatus 10 of the current invention resulted in a marked decrease in the acoustic signature. Such improvements in noise abatement are highly desirable and a strong selling point for the boiler.

Figure 7:
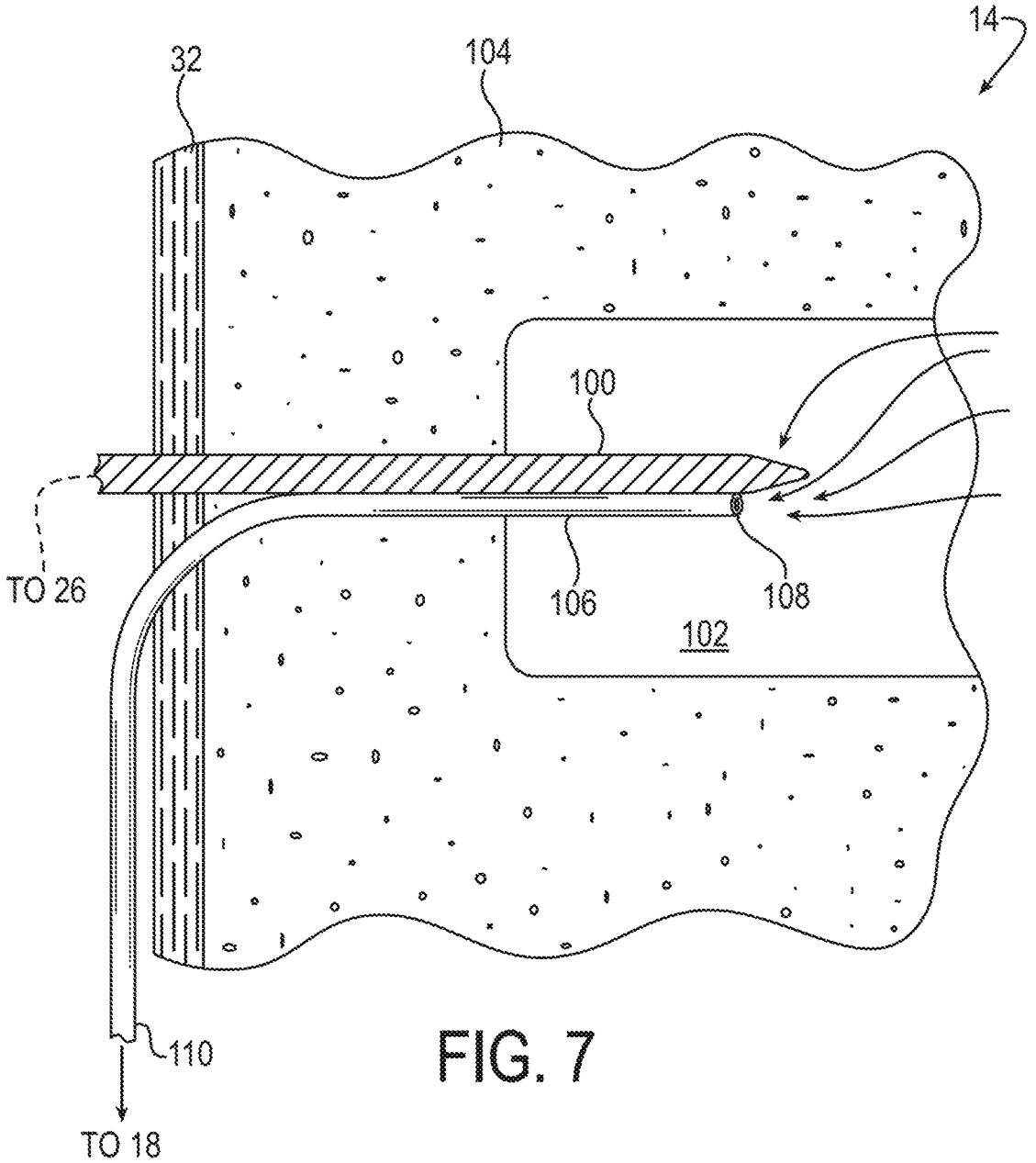
FIG. 7 depicts an enlarged view of the burner assembly of FIG. 1.

An oxygen sensor 100, such as that disclosed in U.S. patent application Ser. No. 13/409,935, assigned to the assignee of the present invention and incorporated by reference herein in its entirety, can be used to detect an amount of oxygen in the products of combustion. In one embodiment, shown in FIGS. 1 and 7, the oxygen sensor 100 mounts to the outer containment vessel 30 and protrudes through the combustion chamber housing 32 to a cavity 102 within a refractory liner 104 inside the combustion chamber. Experimental test data indicated that the oxygen sensor 100, when positioned within the cavity 102, did not detect an oxygen level representative of the actual combustion products. This erroneous data was particularly detrimental to the efficient operation of the water heating apparatus 10 because the oxygen sensor 100 readings served as input to the controller 26. It is believed the reason for the erroneous readings was that the oxygen sensor 100 was located in a "dead spot" that did not receive a continuous flow of combustion gases. One possible remedy to this problem was to position the oxygen sensor 100 farther into the combustion chamber, past the refractory liner 104. However, the oxygen sensor 100 could not withstand direct exposure to the high temperatures.

In one embodiment, the water heating apparatus 10 includes a flow tube 106 that draws combustion gases into the cavity 102 of the refractory liner 104. The flow tube 106 includes a first end 108 positioned in close proximity to the tip of the oxygen sensor 100, and an opposing second end 110 positioned in a location of lower pressure than the combustion chamber. In one example, the second end 110 of the flow tube 106 is disposed in the combustion exhaust manifold 18, which is at a pressure approximately 6 inches water column (IWC) lower than the combustion chamber where the cavity 102 is located. A small, relatively constant stream of combustion gas flows through the flow tube 106 as the gases in the higher pressure plenum seek the lower pressure plenum. The flow into the tube 106 is illustrated by the arrows in FIG. 7. As can be appreciated with reference to FIG. 7, the flow of combustion gas into the first end 108 of the flow tube 106 also causes a steady flow of combustion gas around the tip of the oxygen sensor 100, thereby greatly enhancing the accuracy of the sensor readings. Further, because the oxygen sensor 100 is disposed in the cavity 102 of the refractory liner 104, the sensor stays cooler which contributes to greater accuracy and durability.

Although obscured by the outer containment vessel 30 and combustion chamber housing 32, the burner assembly 14 further includes a cylindrical burner sleeve surrounding the refractory liner 104 on the inlet side of the burner. The burner sleeve, which may be formed of stainless steel, protects the abradable refractory material during installation to and removal from burner assembly 14.

Figure 8:
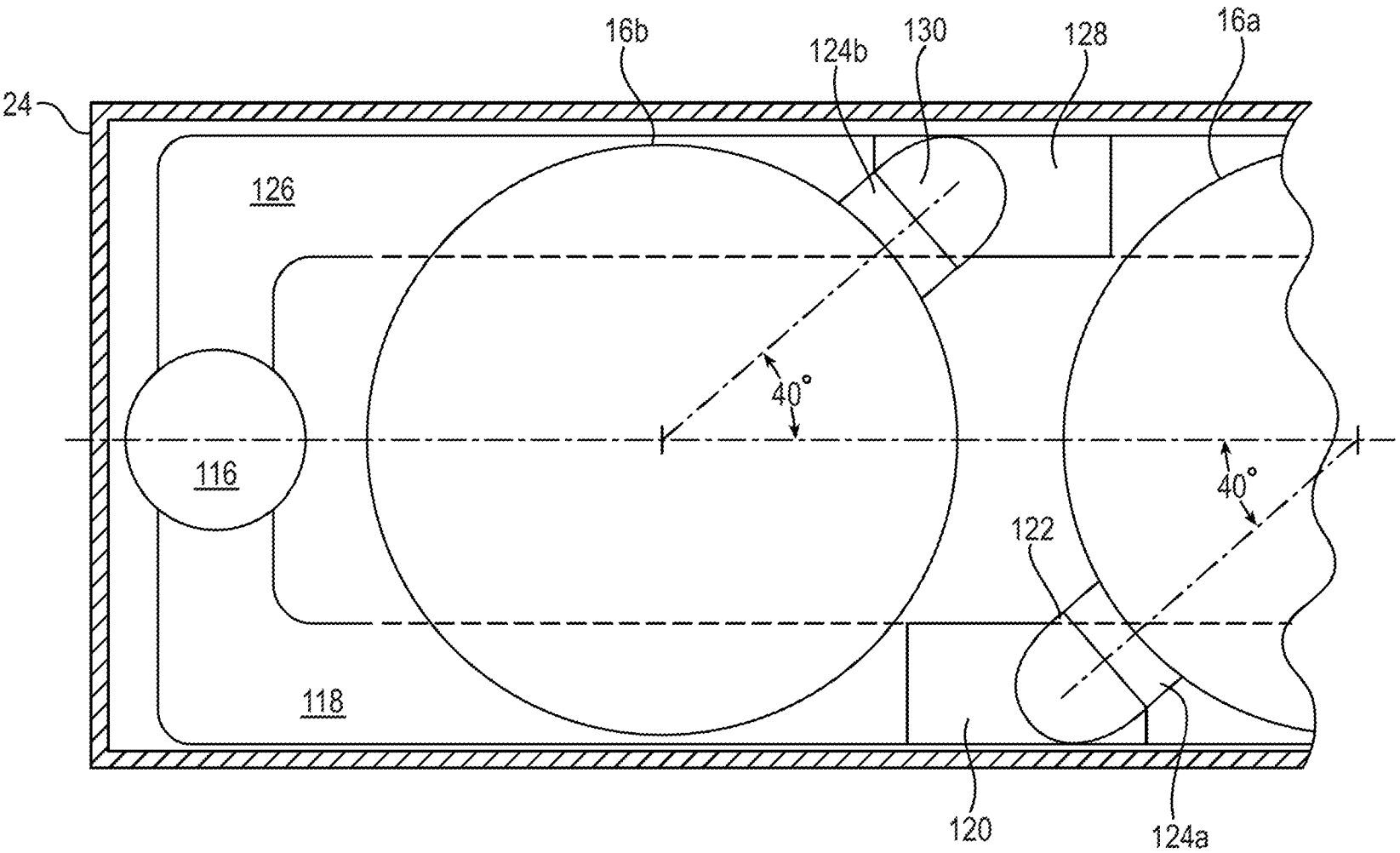
FIG. 8 depicts a top plan view of the water piping arrangement of FIG. 1.

The water heating apparatus 10 of the present invention includes a unique water piping arrangement to supply water to the plurality of heat exchangers at substantially equal flow and pressure, without use of complicated valves, controllers, or specialized orifice plates. The piping arrangement allows the plurality of heat exchangers to operate in parallel, as contrasted to prior art water heating systems that operated in series. Turning now to FIGS. 1 and 8, the water piping arrangement includes the water inlet port 20 located at approximately half the height of the enclosure 24. In the illustrated embodiment, the water inlet port 20 comprises a 6 inch diameter pipe. A first pipe section 112 connected to the water inlet port 20 extends horizontally within the enclosure 24 to approximately the centerline of the heat exchangers, then bends 90 degrees downward to the base of the enclosure 24. In this regard, the first pipe section 112 connects to a first 90-degree elbow 114, which in turn connects to a vertically-oriented second pipe section 116.

Two smaller-diameter piping sections symmetrically extend from the base of the second pipe section 116 and form longitudinal runners to the inlet of each heat exchanger. In the illustrated embodiment, a first supply leg 118 for connection to heat exchanger 16*a* extends laterally away from the second pipe section 116 to the inside wall of the enclosure 24, bends 90 degrees downward to the floor of the enclosure 24, then bends 90 degrees in a longitudinal direction to extend or run partially underneath the heat exchangers, which are somewhat elevated. A first tee 120 connected to the first supply leg 118 is disposed vertically between the heat exchangers 16*a*, 16*b* and connects to a first inlet elbow 122. The first inlet elbow 122 bends 90 degrees to a horizontal orientation, then connects to the inlet port 124*a* of heat exchanger 16*a*. The first inlet elbow 122 and inlet port 124*a* are oriented approximately 40 degrees from the longitudinal axis, as illustrated in FIGS. 8 and 9. In the illustrated embodiment, the smaller-diameter piping sections are 4 inches in diameter.

A second supply leg 126 for connection to heat exchanger 16*b* is symmetric to the first supply leg 118. That is, the second supply leg 126 extends laterally away from the second pipe section 116 (in an opposing direction to the first supply leg 118) to the opposite inside wall of the enclosure 24, bends 90 degrees downward to the floor of the enclosure 24, then bends 90 degrees in a longitudinal direction to extend or run partially underneath the heat exchangers. A second tee 128 (in opposing relation to the first tee 120) connected to the second supply leg 126 is disposed vertically between the heat exchangers 16*a*, 16*b* and connects to a second inlet elbow 130. The second inlet elbow 130 bends 90 degrees to a horizontal orientation, then connects to the inlet port 124*b* of heat exchanger 16*b*. The second inlet elbow 130 and inlet port 124*b* are oriented approximately 40 degrees from the longitudinal axis, as illustrated in FIGS. 8 and 9, but note the symmetry to inlet port 124*a*.

One benefit of the disclosed water piping arrangement is that it provides equal flow and pressure in parallel to each heat exchanger, in a completely passive manner. Importantly, the equal flow conditions exist over the entire operating of the water heating apparatus 10, without the need for a variable orifice or restriction. Equal pressure drops in the first and second supply legs 118, 126 are achieved by designing the legs with equal lengths and equal bends. Furthermore, because the first and second supply legs 118, 126 are incorporated into the base of the enclosure 24 and partially underneath the heat exchangers 16*a*, 16*b*, a more compact form factor can be attained.

Operating multiple heat exchangers in parallel provides the additional benefit of utilizing condensing operation for each of the individual heat exchangers, thereby achieving very high efficiency levels (i.e., greater than 90 percent). In contrast, prior art multiple heat exchangers operating in series seldom, if ever, achieve condensing operation at the same time.

Figure 9A:
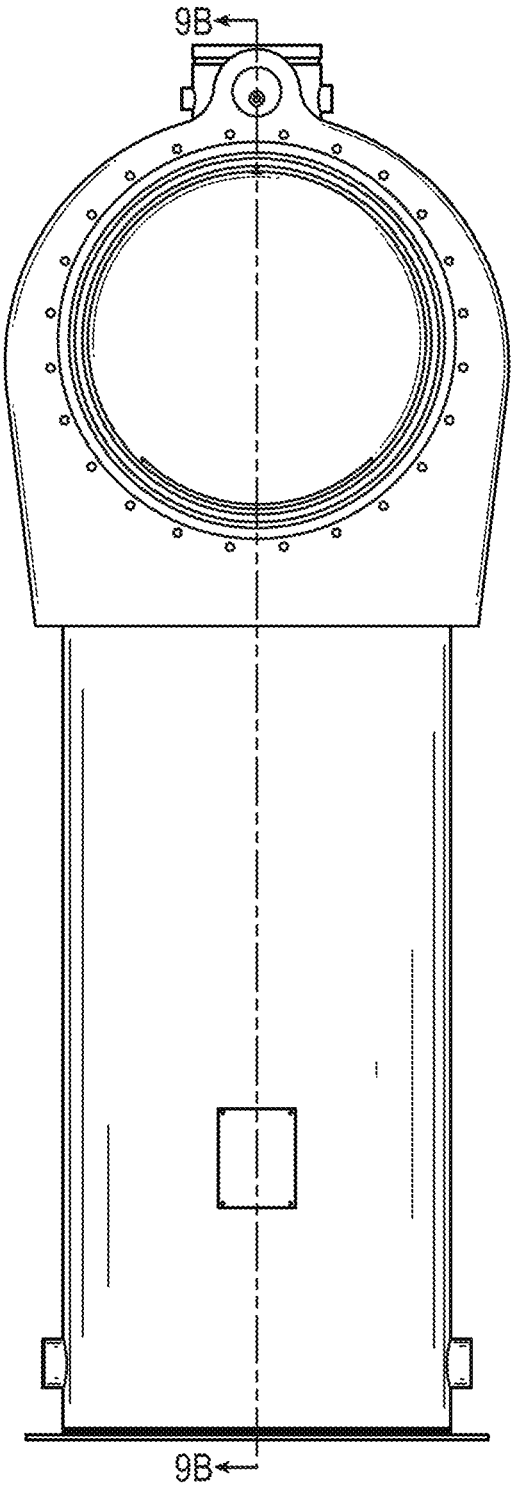
FIG. 9A shows an end view of an exemplary water heating apparatus outer containment vessel of a burner assembly disposed over a vertical heat exchanger.
Figure 9B:
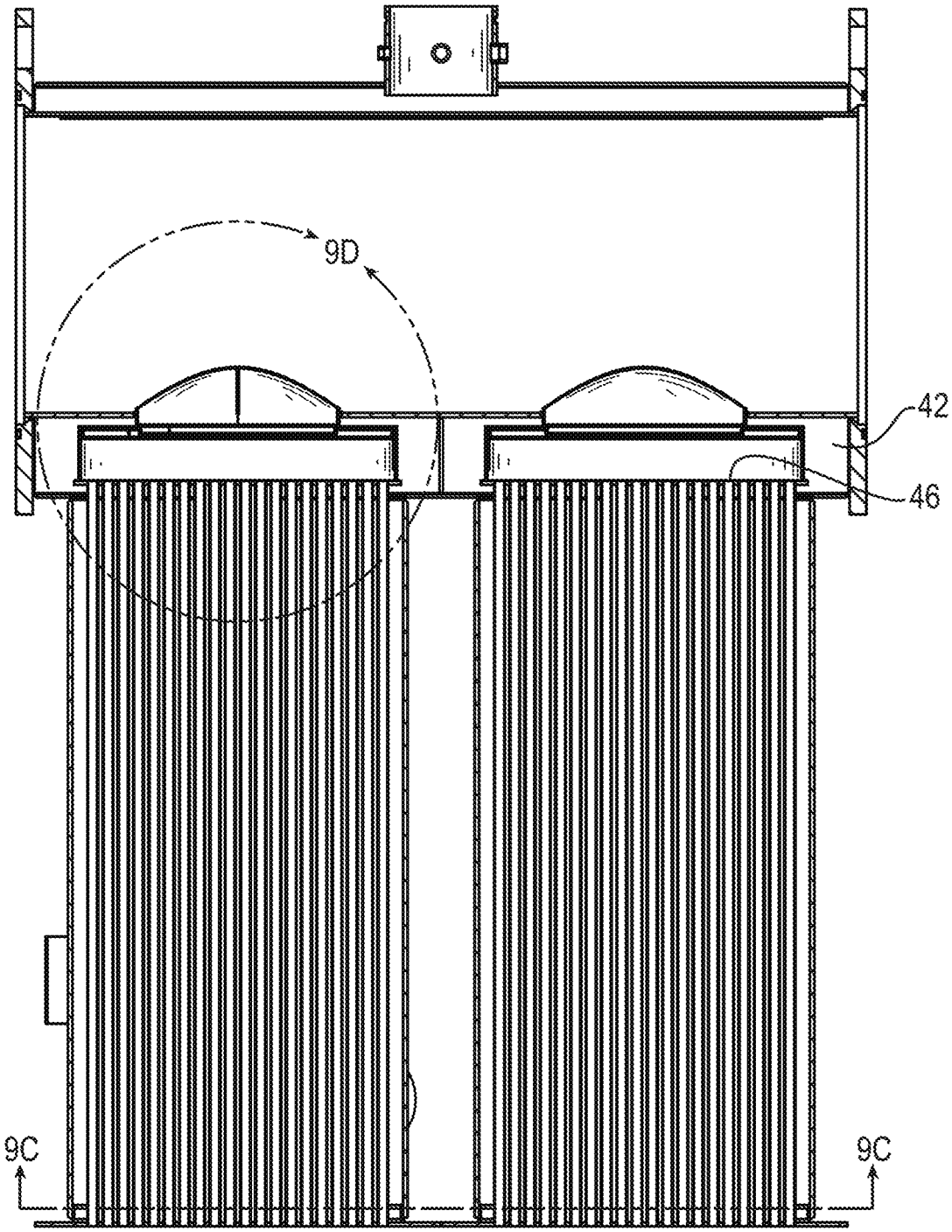
FIG. 9B shows a side view of the assembly of FIG. 9A.
Figure 9C:
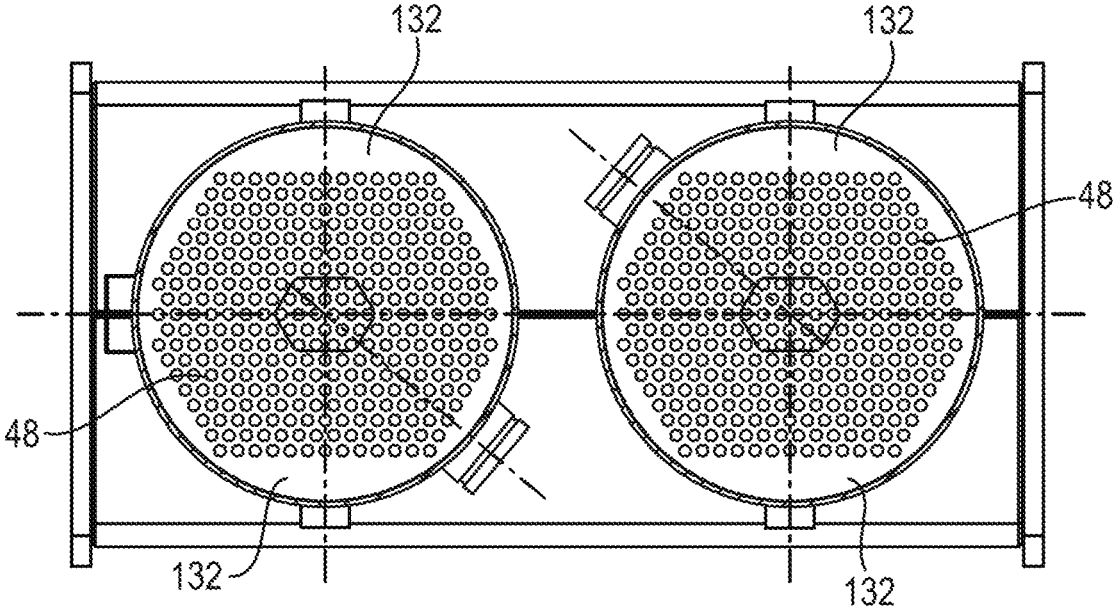
FIG. 9C shows a top view of the assembly of FIG. 9A.
Figure 9D:
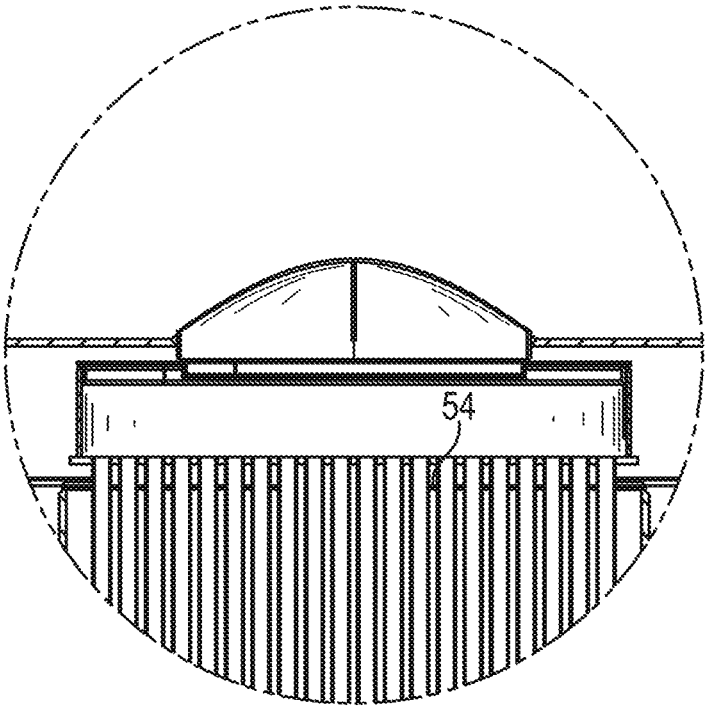
FIG. 9D shows a detail view as marked on FIG. 9B.
Figure 9E:
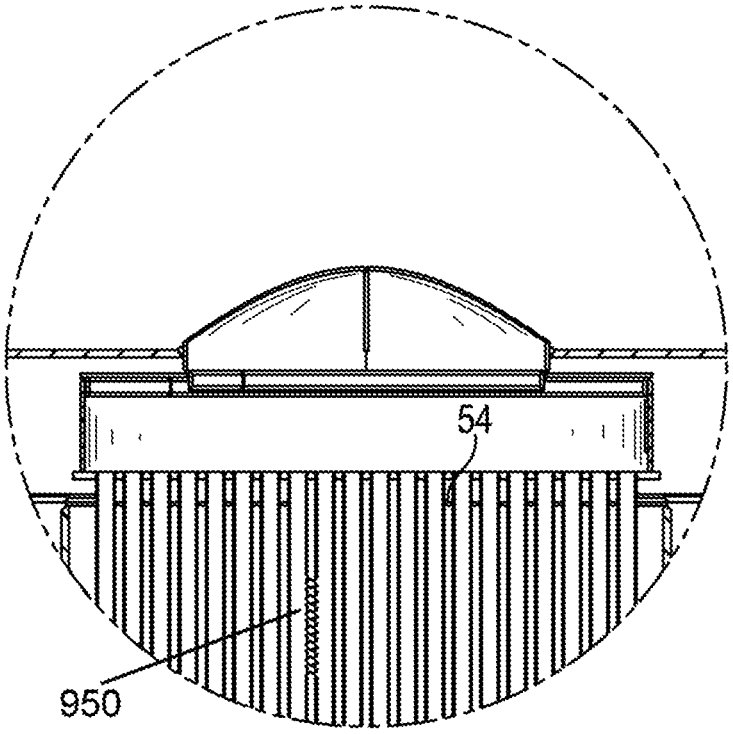
FIG. 9E shows a detail view as marked on FIG. 9B with exemplary spiral grooves.
Figure 10A:
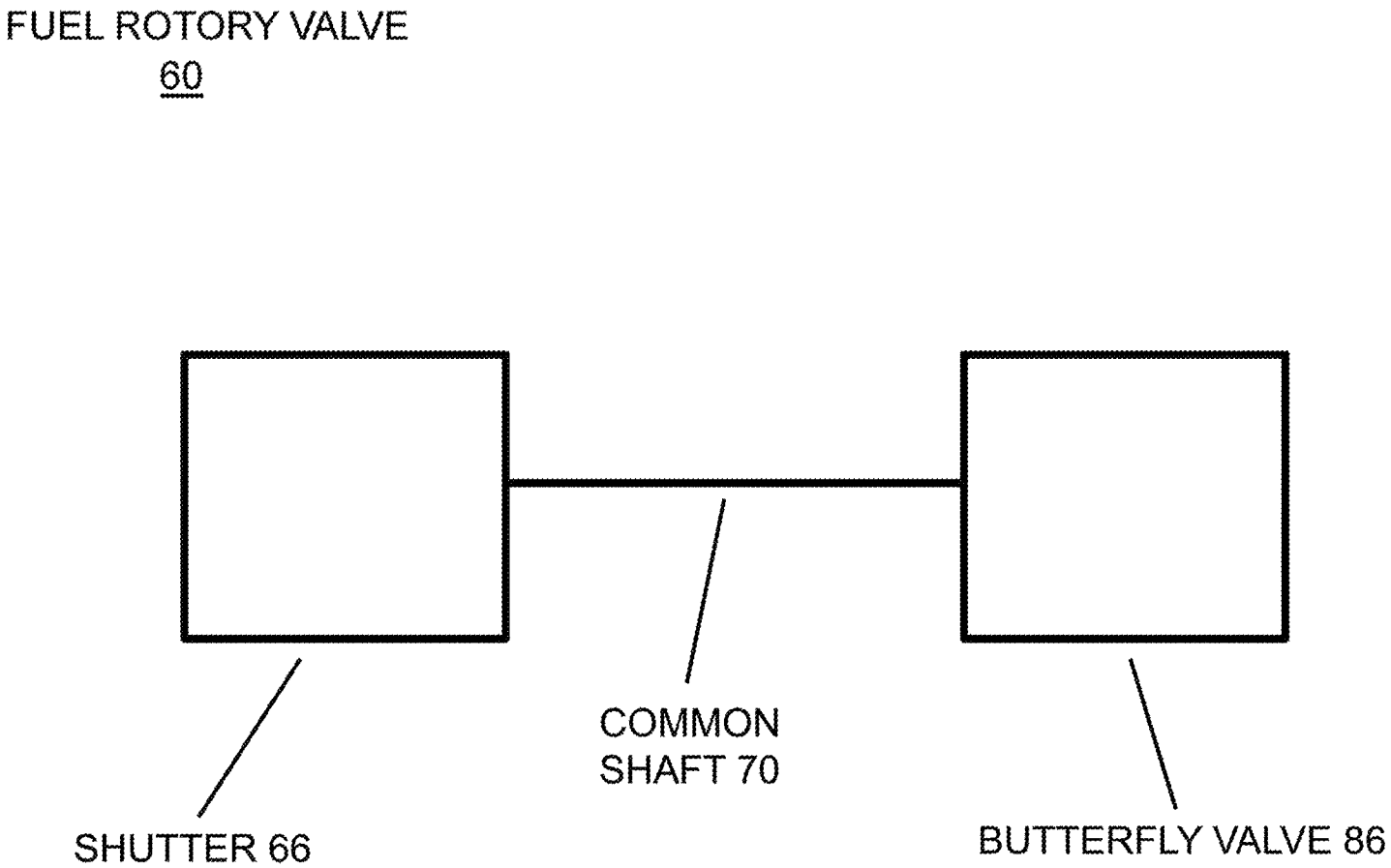
FIG. 10A shows a block diagram of a butterfly valve and shutter of a fuel rotary valve coupled by a common shaft.
Figure 10B:
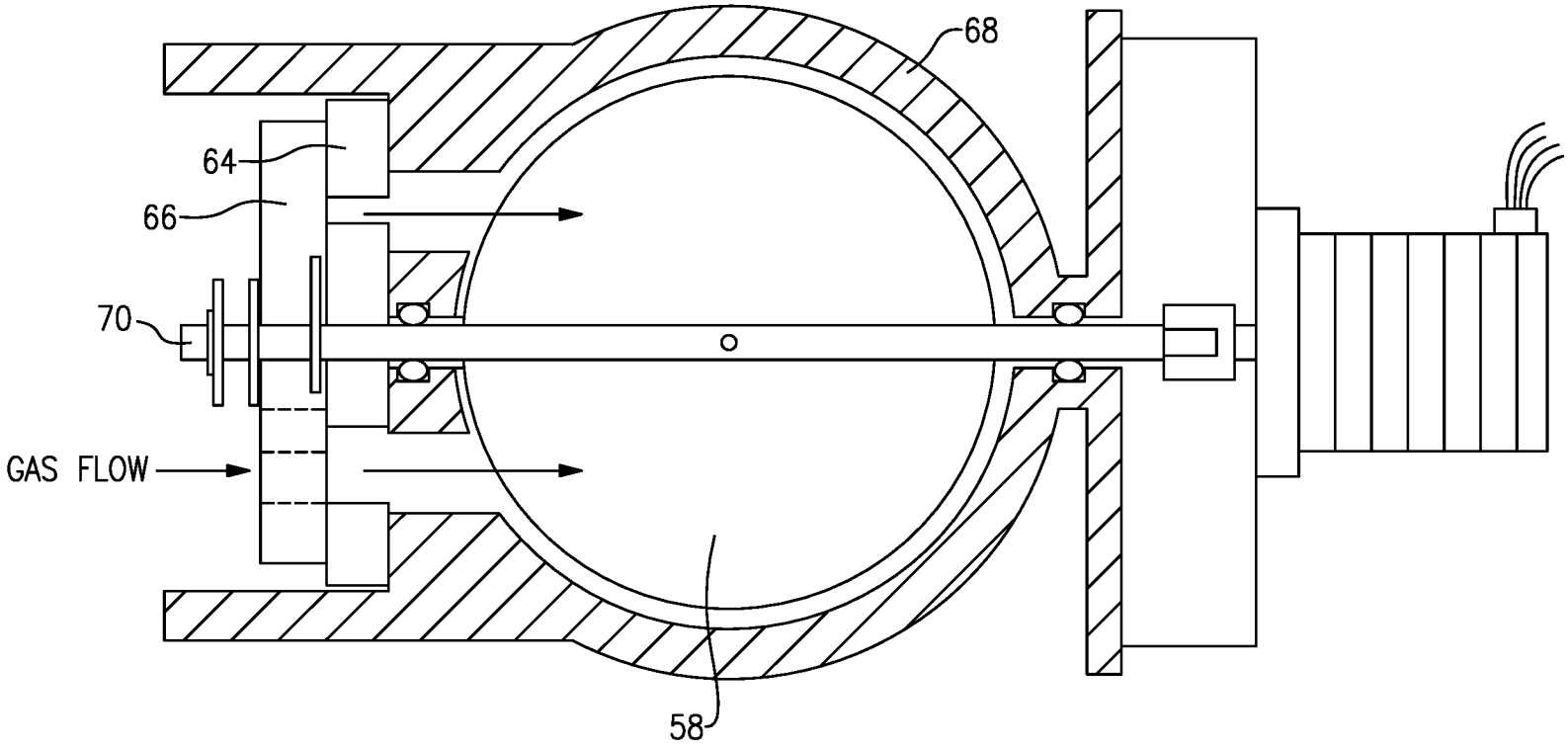
FIG. 10B shows an exemplary butterfly valve and shutter of a fuel rotary valve coupled by a common shaft according to FIG. 10A.

As shown in FIG. 9C, the lower tubesheet 48 (and corresponding upper tubesheet 46) includes quadrants 132 devoid of holes for heat exchange tubes. The reason for this can be appreciated with reference to FIG. 1, where it can be seen the first and second supply legs 118, 126 extend beneath the heat exchangers 16*a*, 16*b*. The weight of the entire water heating apparatus 10 (approximately 4,900 pounds in the disclosed embodiment) passes through the outer perimeter of the heat exchangers 16*a*, 16*b*, through support pads 134, and into the first and second supply legs 118, 126. If heat exchange tubes were brazed or welded to the lower tubesheet 48 in the quadrant 132 where the load was being taken up, the heat exchange tubes would undoubtedly suffer deformation or failure. Accordingly, the tubesheet includes quadrants or areas devoid of heat exchange tubes so water supply legs can be positioned thereunder, thereby further decreasing the footprint or form factor of the water heating apparatus and allowing equal water flow to be delivered to each heat exchanger.

The physical layout of the components described herein provides for a compact form factor for the water heater system. In one embodiment of the present invention, a hydronic boiler system produces 6 million BTU/hr. heat exchange capacity while the enclosure 24 occupies a form factor of less than 36 inches wide, less than 82 inches high, and approximately 87 inches in depth. In one example, the form factor is 34 inches wide, 79 inches high, and 87 inches in depth. Thus, the disclosed water heating apparatus 10 will pass through a standard-sized doorway to a building's mechanical room.

In contrast, calculations show that a 6 million BTU/hr. water heating system comprising a single heat exchanger would need to be approximately 38 inches in diameter, which would not fit through a standard doorway of a mechanical room. The larger diameter heat exchanger would thus require a much larger tubesheet, which would not dissipate heat as well. Should the single heat exchanger be formed as an oval to maintain a smaller width, calculations show the flat side, not being a good pressure vessel, would need to be over 1 inch thick, which adds considerable cost and weight to the installation.

FIG. 11A to FIG. 11H show another embodiment of a pressure vessel assembly for a hot water heater similar to the embodiment of FIG. 1. The previous description of a burner assembly 14 and blower 28 and related hardware structures, including fuel flow and hot combustion gas flow (not shown in FIG. 11A to FIG. 11H) are all applicable to the pressure vessel assembly for a hot water heater of FIG. 11A to FIG. 11H. Also, the outer containment vessel and water jacket 1152 defined by the area between the outer containment vessel 30 and the combustion chamber housing (not shown in FIG. 11A to FIG. 11H) operate in the same way with a similar internal structure, where after picking up additional heat in the water jacket 1152 from the burner assembly 14, the water exits the water heating apparatus 10 via water outlet port 1122. As described hereinabove, the water jacket 1152 (FIG. 1, 52) is a new way to combine parallel heat exchangers which are heated by a single burner assembly. The operating modes, methods, burner structures, heat exchanger structures (e.g. including tube structures), and processes described hereinabove with respect to the embodiment of FIG. 1 also apply to the embodiment of FIG. 11A to FIG. 11H.

What is different in the embodiment of FIG. 11A to FIG. 11H is the structure which provides equal flow and pressure in parallel to each heat exchanger, in a completely passive manner. Importantly, the equal flow conditions also exist over the entire operating of the water heating apparatus 10, without the need for a variable orifice or restriction. Equal pressure drops in the first and second supply leg elbows 1181125, 1124 are achieved by legs having equal lengths and equal bends. Furthermore, because the first and second supply leg elbows 1125, 1124 are incorporated very close to the sides of the heat exchangers 1116*a*, 1116*b*, a more compact form factor can be attained.

Figure 11A:
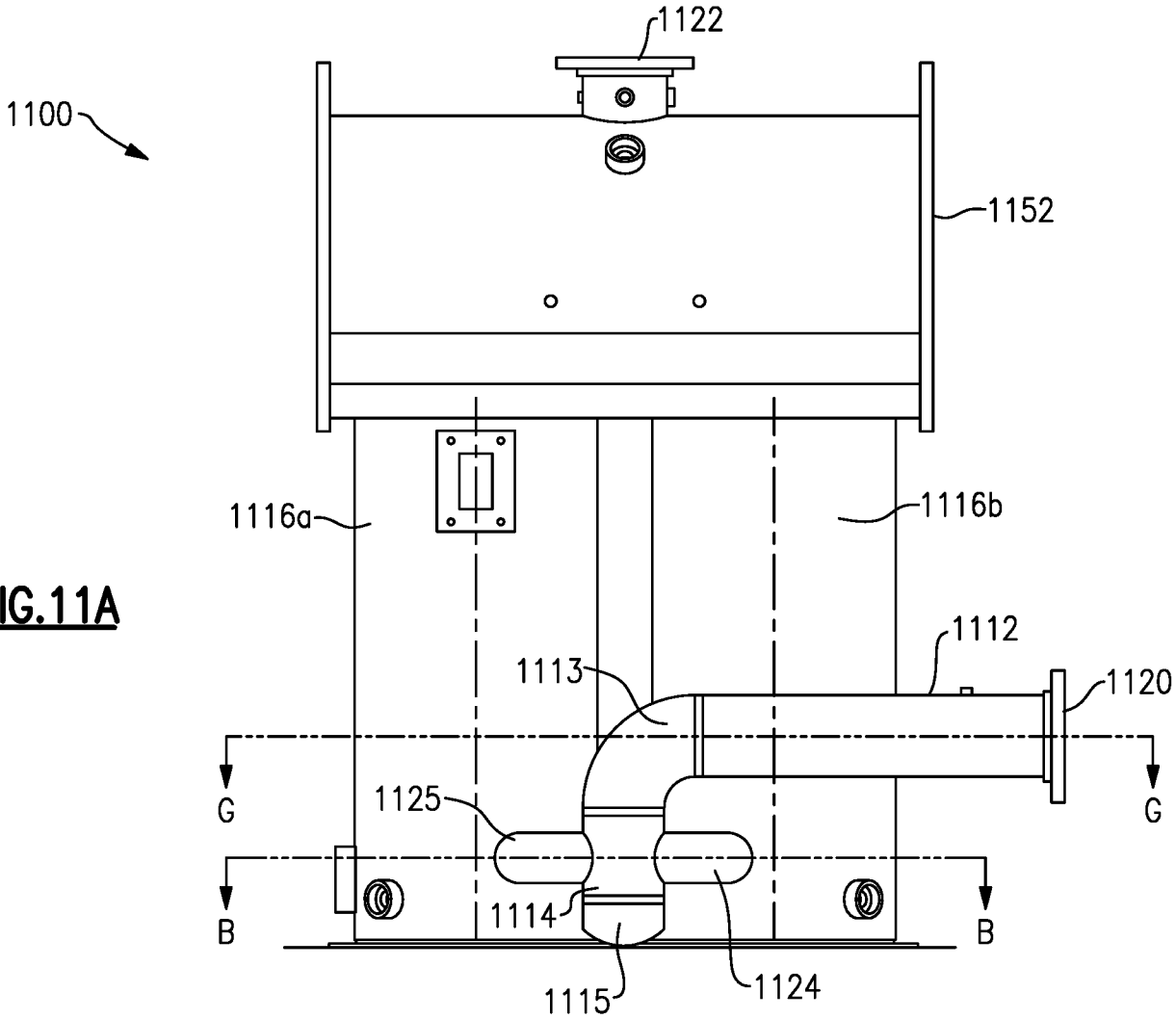
FIG. 11A shows another exemplary embodiment of a water heater.
Figure 11C:
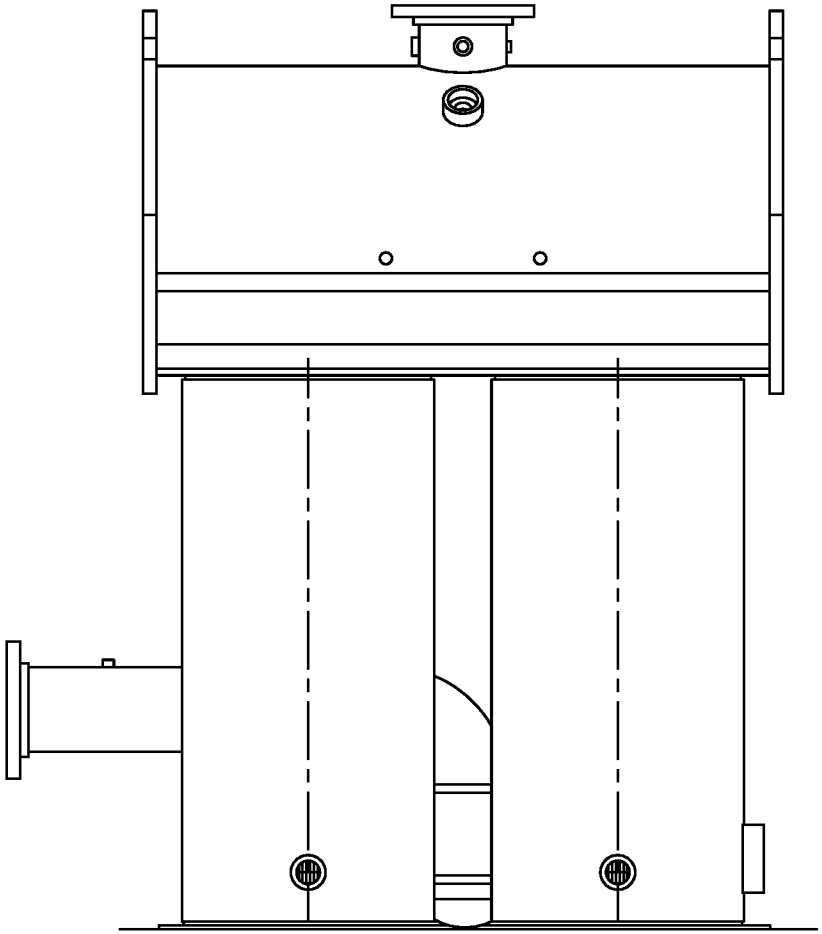
FIG. 11C shows a side view of the water heater of FIG. 11A.
Figure 11B:
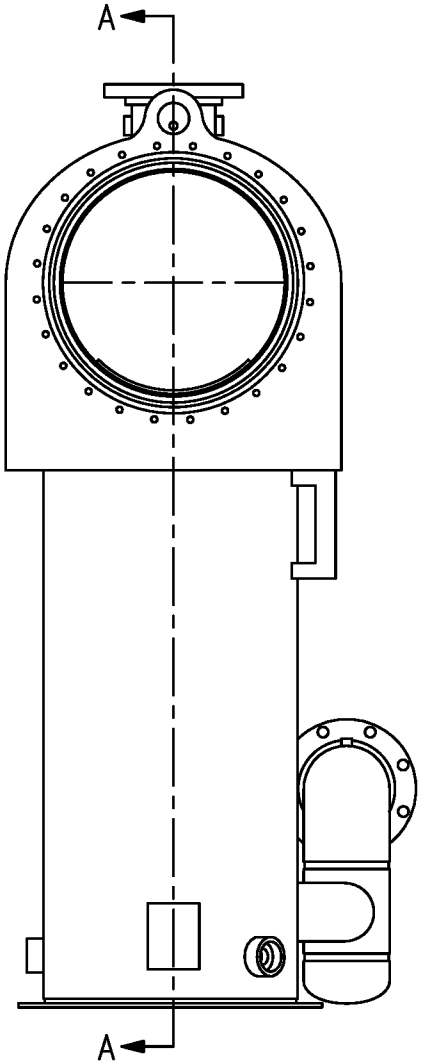
FIG. 11B shows an end view of the water heater of FIG. 11A.
Figure 11G:
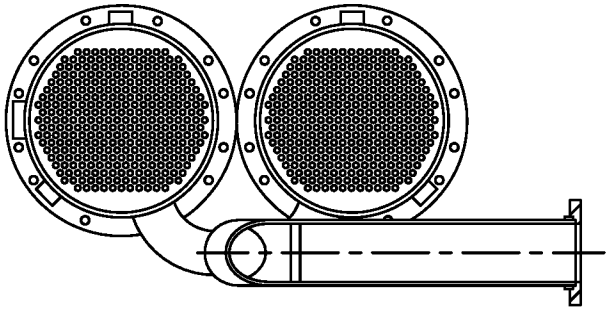
FIG. 11G shows a top cut away view of the water heater of FIG. 11A.
Figure 11D:
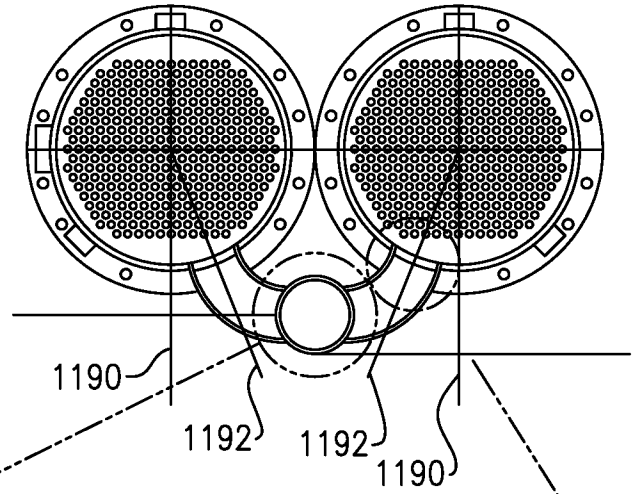
FIG. 11D shows a bottom view of the water heater of FIG. 11A.
Figure 11F:
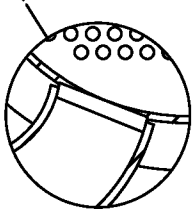
FIG. 11F shows a cut away view of connecting pipe for the water heater of FIG. 11A.

FIG. 11A shows an exemplary embodiment of a water heater 1100 having a cold-water inlet port 1120 and a hot water outlet port 1122. A first pipe section 1112 bends about 90 degrees at elbow 1113 into a distribution section 1114, which continues to a cap section 1115. Distribution section 1114 is coupled into two elbows 1125, 1124 which are coupled to a cold-water input port of each heat exchanger 1116*a*, 1116*b* respectively. In the embodiment of FIG. 11A to FIG. 11H, the supply legs of FIG. 1 are substantially replaced by elbows 1125, 1124 created a short path and more efficient cold-water distribution system to provide and equal flow and pressure in parallel to each heat exchanger. While elbows 1125, 1124 can have any suitable bend angle, the exemplary embodiment uses a bend angle of about 30 degrees which sets elbow 1113 and distribution section 1114 relatively close in to the sides both of heat exchangers 1116*a*, 1116*b* for an efficient relatively narrow water heater apparatus package with or cabinet width as the water heater is typically packaged within a protective and decorative outer cabinet. As seen in the bottom view of FIG. 11D, where a reference line is shown drawn from a center point of the heat exchanger to an outside edge of the circular perimeter of the cylindrical heat exchanger cylindrical casing is defined as 90 degree axis line 1190, the heat exchange cold-water inlet openings of each heat exchangers are about offset inward in a direction towards an area between the two heat exchangers along the outer surface by about 22 degrees (offset axis lines 1192) along the cylindrical perimeter circumference of the heat exchangers. The 22 degree offset axis lines 1192 from the 90 degree axis line 1190 (i.e. about in a plane parallel to a mounting plane such as a floor, from a center of each heat exchanger to a side of the water heating apparatus), which corresponds to the about 30 degree elbows 1125, 1124 each of the elbows 1125, 1124 leading in from each side of the distribution section 1114 respectively. For example, in other less desirable, but still feasible embodiments, if elbows 1125, 1124 were each 90 degree elbows, they would couple to heat exchanger water inlet ports at about the 90 degree line, where elbow 1113 and distribution section 1114 are farther away from the sides of the heat exchangers causing a wider water heater package and cabinet width.

While exact dimensions are less important, the new structures of the Application including the water jacket to combine two or more heat exchangers with one common burner assembly as well as the close in piping, such as by use of 30 degree elbows continue to make for a water heater package with compact size per BTU of water heating capability. For example, in one exemplary implementation, according to the embodiment of FIG. 11A to FIG. 11H the pressure vessel assembly height is about 72 inches, the side width is about 32 inches, and the end width is about 48 inches.

Figure 11E:
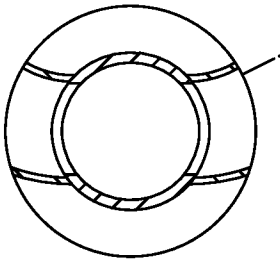
FIG. 11E shows a detail of the equal flow distribution ports of the water heater of FIG. 11A.
Figures 11H, 11I, 11J:
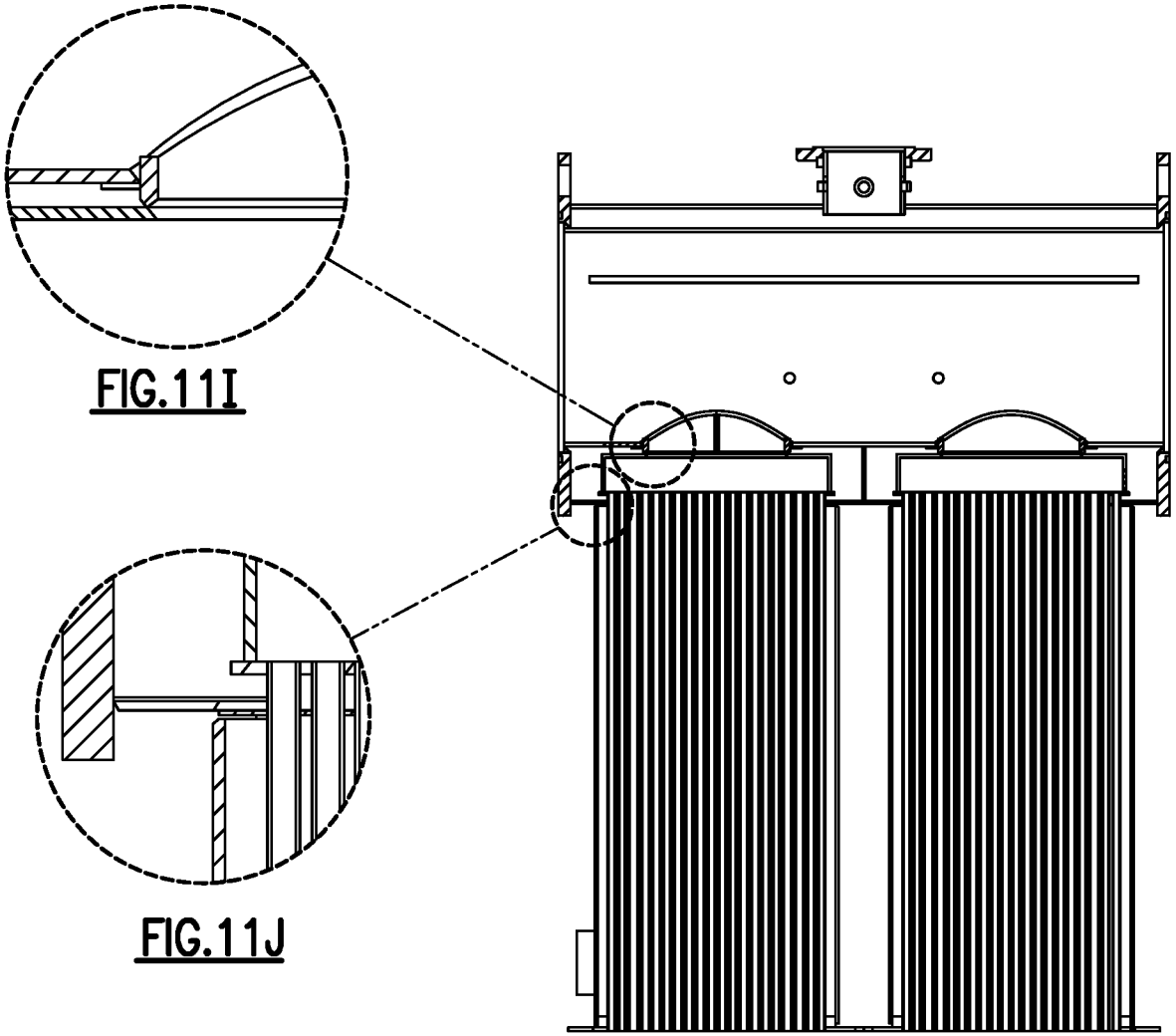
FIG. 11H shows a cut away side view of the water heater of FIG. 11A.
FIG. 11I shows a cut away view of the joint connecting the heat exchanger to the combustion chamber of the water heater of FIG. 11A.
FIG. 11J shows a cut away view of the lower pressure vessel pipe to the upper water jacket pressure vessel of the water heater of FIG. 11A.

The radial sweep of the 6" elbow and the 4" distribution elbows shown in FIG. 11A act to minimize the side width of the heat exchanger by keeping the 6" piping very close to the side of the heat exchanger cylinders. This closeness can be seen in FIG. 11B. FIG. 11E shows the detail of the scarf cut that is needed to join the two 4" pipes to the 6" pipe with an external joint that prevents internal constriction of the water flow path into the distribution pipes. This is critical to prevent acceleration of the water at high flow rates with the potential to cause erosion of the pipe material over time.

In yet another embodiment, there can be dual cold-water inlets on each heat exchanger, as compared to the single heat exchanger cold-water inlets of the embodiments of FIG. 1 and FIG. 11.

Figure 12A:
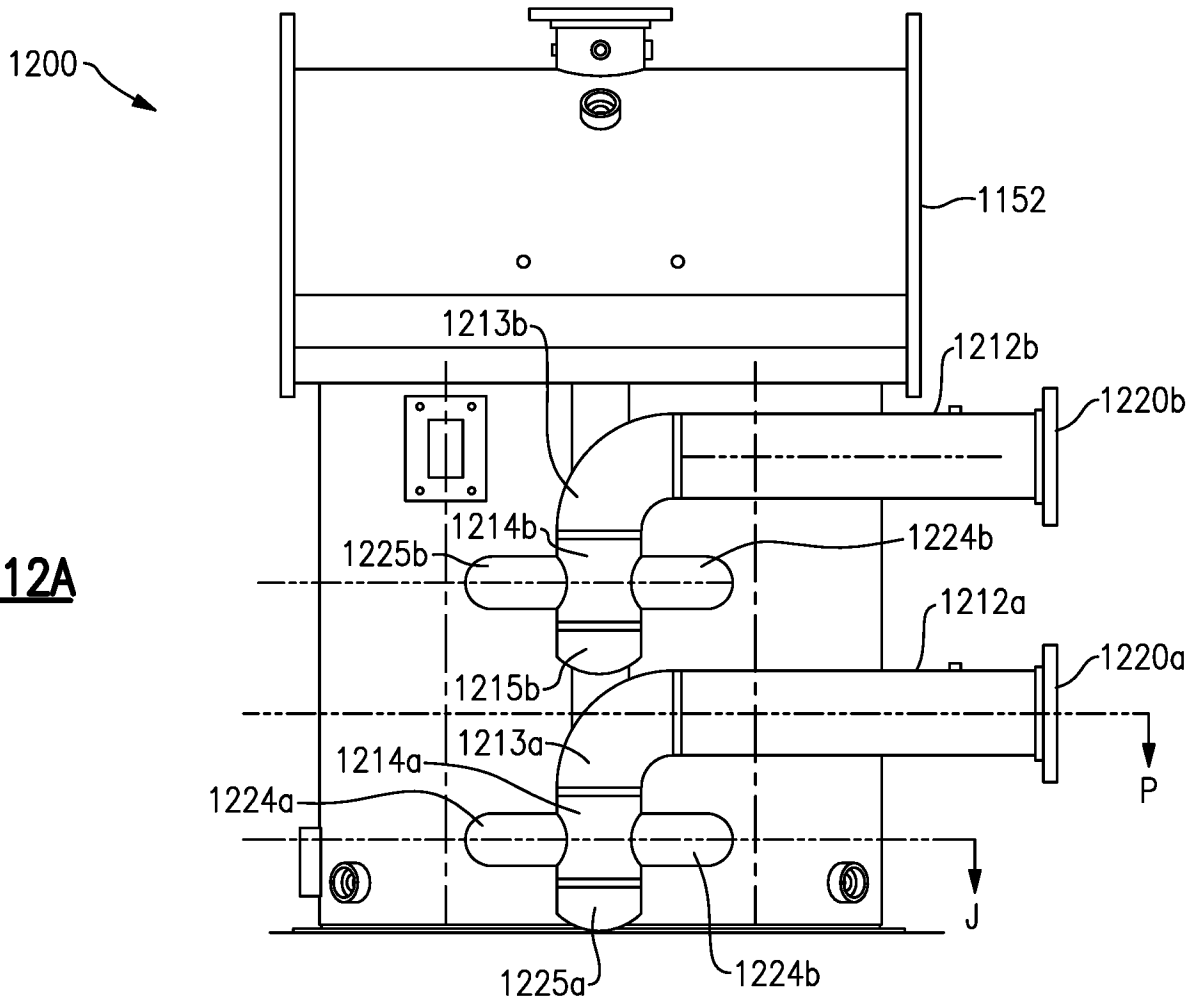
FIG. 12A shows yet another exemplary embodiment of a water heater.
Figure 12C:
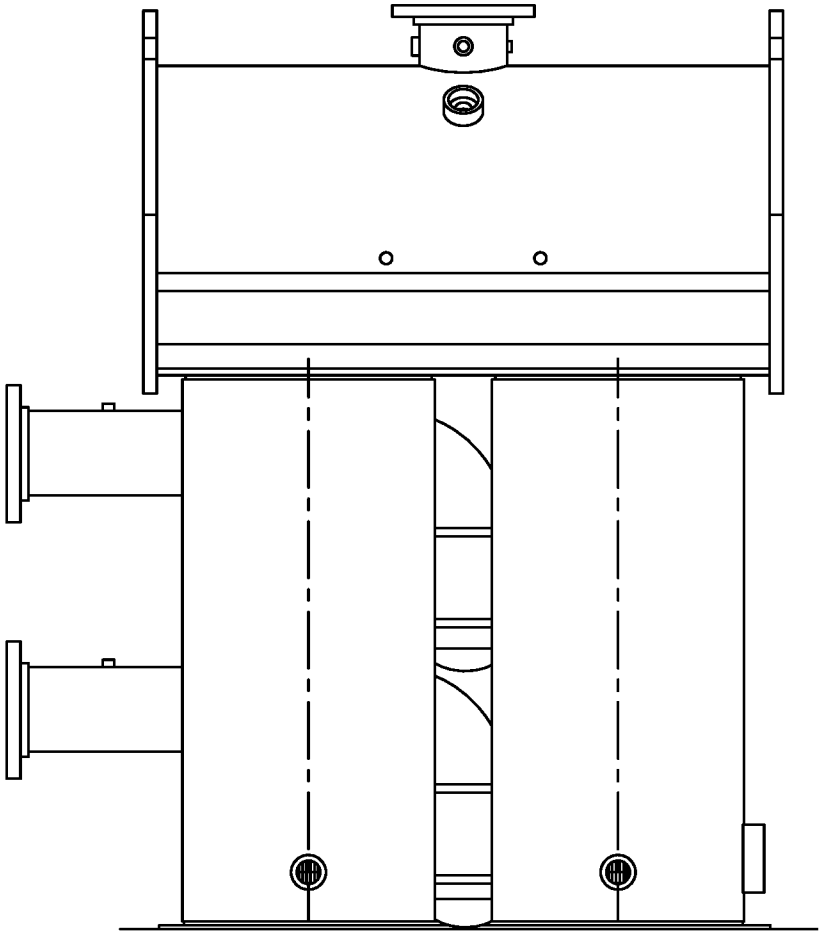
FIG. 12C shows a side view of the water heater of FIG. 12A.
Figure 12B:
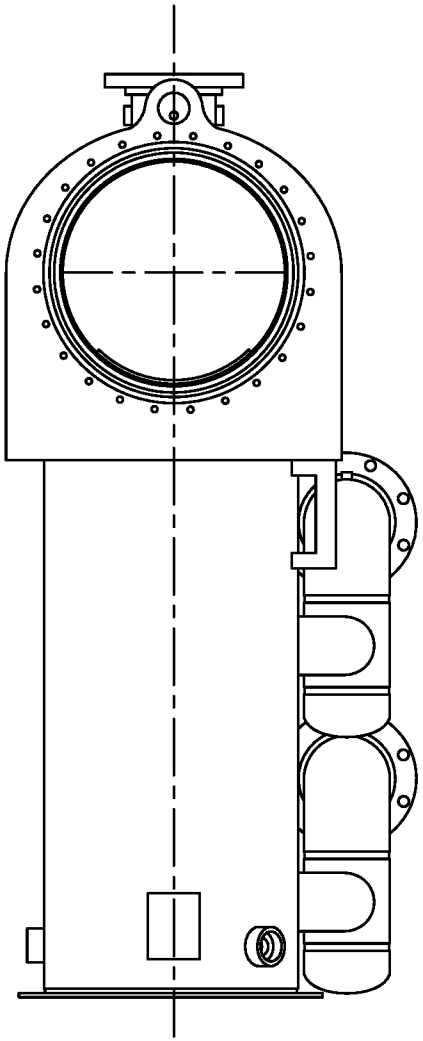
FIG. 12B shows an end view of the water heater of FIG. 12A.

FIG. 12A to FIG. 12C show drawings of another embodiment of a pressure vessel assembly for a hot water heater similar to the embodiment of FIG. 11A. What is different in FIG. 12A to FIG. 12C is that there are now two parallel water inlets 1220*a*, 1220*b*, with two corresponding structures leading into the two parallel heat exchangers via first pipe sections 1212*a*, 1212*b*, elbows 1213*a*, 1213*b*, distribution sections 1214*a*, 1214*b*, and elbows 1224*a*, 1224*b*, and 1225*a*, 1225*b*.

Typically, the water inlet 1220*a* will be connected (fluidly coupled) to a water supply with the lowest return temperature from the building loop. Also, typically, inlet 1220*b* will be connected (fluidly coupled) to a water supply with a higher return water temperature from the building loop. This arrangement, a blending of warm and cool water from a building's warm and cool water return lines directly within each of the heat exchangers, ensures maximum efficiency of the water heater because the cooler water entering 1220*a* will extract the maximum amount of heat from the internal fire tubes. When operated in this manor efficiency increases of 1 to 5% are achievable, over the blending of warm and cool water return lines prior to entering the water heater.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A water heating apparatus comprising:

a water inlet port and a hot water supply connection water outlet port;

a burner assembly comprising a burner disposed within a combustion chamber housing;

at least two heat exchangers operated in parallel, each of the at least two heat exchangers fluidly coupled to said water inlet port, at least two of said at least two heat exchangers having at least a first heat exchanger water inlet port on a same side of the water heating apparatus, each of the heat exchangers having an outer housing and disposed within a plurality of heat exchange tubes and a portion through which a heated water exits each of the at least two heat exchangers;

a water jacket defined by an area between an outer containment vessel and the combustion chamber housing;

wherein a hot combustion gas from the burner assembly flows through each of the at least two heat exchangers to heat a cold water from the at least a first heat exchanger water inlet to a heated water; and wherein the heated water flows out of each of each of the at least two heat exchangers through the portion of each of the at least two heat exchangers into the water jacket, where the heated water flowed into the water jacket is further heated by the combustion chamber housing and the further heated water exits the water heating apparatus at the hot water supply connection water outlet port.

2. The water heating apparatus of claim 1, comprising an elbow fluidly coupled to said water inlet port of each of said at least two heat exchangers by a distribution section of a supply leg, said elbows and said distribution section disposed on a same side of the water heating apparatus.

3. The water heating apparatus of claim 2, wherein said elbow comprises about a 30 degree elbow.

4. The water heating apparatus of claim 1, wherein each of said at least a first heat exchanger water inlet of each of said at least two heat exchangers is disposed at about a 20 degree offset from a 90 degree axis line from a center of each heat exchanger to a side of the water heating apparatus.

5. The water heating apparatus of claim 1, wherein each heat exchanger of at least two of said at least two heat exchangers comprise at least two heat exchanger water inlet ports, and an elbow fluidly coupled to each of said at least two heat exchanger water inlet ports of each of said at least two heat exchangers by at least two distribution sections of at least two supply legs, said elbows and said at least two distribution sections disposed on a same side of the water heating apparatus.

6. The water heating apparatus of claim 1, wherein the hot combustion gas flows through the inside of the heat exchange tubes, while a water to be heated flows within the outer housing in heat exchange relationship around an exterior of the heat exchange tubes.

7. The water heating apparatus of claim 1, wherein within each of the at least two heat exchangers, the hot combustion gas flows in a first direction, while a water to be heated flows in an opposite direction.

8. The water heating apparatus of claim 1, wherein at least one of the at least two heat exchangers comprises a baffle.

9. The water heating apparatus of claim 8, wherein the baffle is welded at an expansion joint below an upper tubesheet as a flow diverter.

10. The water heating apparatus of claim 8, wherein the baffle comprises a circular disk with a central opening.

11. The water heating apparatus of claim 8, wherein the baffle comprises a disk with a central, downward indentation with openings at its edges.

12. The water heating apparatus of claim 1, wherein the outer containment vessel comprises a carbon steel.

13. The water heating apparatus of claim 1, wherein the combustion chamber housing comprises a stainless steel.

14. The water heating apparatus of claim 1, wherein the at least two heat exchangers operated in parallel receive a substantially equal water flow and water pressure from the water inlet port.

15. The water heating apparatus of claim 1, wherein each heat exchanger said at least two heat exchangers comprises said first heat exchanger water inlet port, and a second heat exchanger water inlet port disposed between said first heat exchanger water inlet port and an end of a heat exchanger nearest said water jacket on a same side of the water heating apparatus, said first heat exchanger water inlet port adapted to receive a first return water from a first water return line of a building, and said second heat exchanger water inlet port adapted to receive a second return water from a second return water line of said building, said second return water having a higher temperature than said first return water.

16. The water heating apparatus of claim 15, wherein a blending of warm and cool water from a building's warm and cool water return lines directly within each of the heat exchangers causes a blending efficiency about 1% to 5% higher than a blending of warm and cool water return lines prior to entering the water heating apparatus.

* * * * *